US011519228B2

(12) United States Patent
Richard et al.

(10) Patent No.: US 11,519,228 B2
(45) Date of Patent: Dec. 6, 2022

(54) JOINTED PIPE INJECTOR TRIGGER MECHANISM

(71) Applicant: AUTOMATED RIG TECHNOLOGIES LTD., Calgary (CA)

(72) Inventors: David Louis Richard, Calgary (CA); Harold James Miller, Calgary (CA); Ivan Amic, Calgary (CA); Christopher Jason Serran, Windsor (CA); Jason Brent Schroeder, Edmonton (CA); Alejandro Dino Chavez, Edmonton (CA)

(73) Assignee: AUTOMATED RIG TECHNOLOGIES LTD., Calgary (CA)

( * ) Notice: Subject to any disclaimer, the term of this patent is extended or adjusted under 35 U.S.C. 154(b) by 0 days.

(21) Appl. No.: 17/384,521

(22) Filed: Jul. 23, 2021

(65) Prior Publication Data

US 2021/0348456 A1 Nov. 11, 2021

Related U.S. Application Data

(63) Continuation-in-part of application No. 16/647,464, filed as application No. PCT/CA2019/050078 on Jan. 22, 2019, now Pat. No. 11,078,735.

(60) Provisional application No. 62/622,575, filed on Jan. 26, 2018.

(51) Int. Cl.

| | |
|---|---|
| ***E21B 19/084*** | (2006.01) |
| ***B66D 3/00*** | (2006.01) |
| ***E21B 19/22*** | (2006.01) |

(52) U.S. Cl.
CPC ..... *E21B 19/084* (2013.01); *B66D 3/003* (2013.01); *E21B 19/22* (2013.01)

(58) Field of Classification Search
CPC ..... E21B 19/084; E21B 19/22; E21B 19/08; B66D 3/003
See application file for complete search history.

(56) References Cited

U.S. PATENT DOCUMENTS

| | | | | |
|---|---|---|---|---|
| 4,515,220 | A | 5/1985 | Sizer et al. | |
| 4,655,291 | A * | 4/1987 | Cox | E21B 19/22 166/85.5 |
| 5,094,340 | A | 3/1992 | Avakov | |
| 5,360,075 | A | 11/1994 | Gray | |

(Continued)

OTHER PUBLICATIONS

International Preliminary Report on Patentability, Ch. I, on PCT Appl. Ser. No. PCT/CA2019/050078 dated Aug. 6, 2020 (7 pages).

(Continued)

*Primary Examiner* — James G Sayre
(74) *Attorney, Agent, or Firm* — Foley & Lardner LLP

(57) ABSTRACT

A trigger mechanism is provided for a passive rotating jointed tubing injector having gripper blocks for moving connected, segmented oilfield tubulars axially into or out of horizontal, extended-reach oil and natural gas wells that may contain pressurized fluid or gas to complete for production, work over and service the wells, utilizing an operation commonly known as snubbing. The trigger mechanism can open the gripper blocks when a tapered upset section of increasing diameter on the tubulars is encountered that would not otherwise fully open and operate the gripper blocks.

20 Claims, 44 Drawing Sheets

(56) References Cited

U.S. PATENT DOCUMENTS

| | | | | |
|---|---|---|---|---|
| 5,975,203 | A * | 11/1999 | Payne | E21B 19/22 166/77.2 |
| 6,719,043 | B2 | 4/2004 | Austbo et al. | |
| 6,892,802 | B2 | 5/2005 | Kelly et al. | |
| 6,892,810 | B2 | 5/2005 | Austbo et al. | |
| 6,910,530 | B2 | 6/2005 | Austbo et al. | |
| 6,968,894 | B2 | 11/2005 | Austbo et al. | |
| 2003/0209346 | A1 | 11/2003 | Austbo et al. | |
| 2004/0159426 | A1 | 8/2004 | Austbo et al. | |
| 2004/0159427 | A1 | 8/2004 | Austbo et al. | |
| 2004/0159443 | A1 | 8/2004 | Austbo et al. | |
| 2004/0188100 | A1 | 9/2004 | Austbo et al. | |
| 2006/0081368 | A1 | 4/2006 | Rosine et al. | |
| 2009/0272520 | A1 * | 11/2009 | Hug | E21B 19/22 166/384 |
| 2015/0167405 | A1 | 6/2015 | Hickey | |

OTHER PUBLICATIONS

International Search Report and Written Opinion on PCT Appl. Ser. No. PCT/CA2019/050078 dated Apr. 18, 2019 (8 pages).

* cited by examiner

JOINTED PIPE INJECTOR TRIGGER MECHANISM

CROSS-REFERENCE TO RELATED APPLICATIONS

This application is a Continuation-In-Part of U.S. patent application Ser. No. 16/647,464, filed Mar. 13, 2020, which is a National Stage Entry of International Patent Application No. PCT/CA2019/050078, filed Jan. 22, 2019, which claims benefit of U.S. Provisional Patent Application No. 62/622,575, filed Jan. 26, 2018, all of which are incorporated by reference into this application in their entirety.

TECHNICAL FIELD

The present disclosure is related to the field of injecting segmented (jointed) pipe or tubing into a well, in particular, systems and methods for continuously pushing, forcing, snubbing or stripping a tubular string into or controlling when pulling or resisting the movement of a tubular string out of pressurized and/or horizontal well bores.

BACKGROUND

In recent years, new technologies have been introduced that have increased the industry's ability to drill oil and gas wells horizontally to great measured lengths. Conventional vertical or directional oil or gas completion, workover, and service rigs primarily use the force of gravity to move drilling, completion, workover, and service tools to the full measured length of the oil or gas wells to complete, work over, or service the wells. When horizontal wells are drilled such that the horizontal section is longer than the length of the vertical section, it becomes difficult to move the tools to the end of the well for the purpose of completing, working over, or servicing the well including the drilling and removing of fracturing ("fracing") plugs. The well may also contain well bore pressures when the tools are being introduced into or removed from the wellbore, creating a need to force the tools into the wellbore against that pressure until such point that the weight of the oil field tubular string overcomes the force of the wellbore pressure against it, or to resist the force exerted on the tools and pipe by the wellbore pressure forcing the tools from the wellbore.

It has been found that cuttings and debris tend to collect in the lower side of the horizontal well sections and that pipe string rotation helps to distribute the debris and cuttings into the annular area to help the circulating fluid to carry it out of the wellbore.

The industry has commonly used continuous coiled tubing injector technology or segmented oil field tubular snubbing jack technology to complete, work over and service the oil and natural gas wells under pressure.

Limitations have been realized when utilizing continuous coiled tubing injector technology as the horizontal sections get longer. Limiting factors of coiled tubing are transportability to get to the well sites and the ability to push the continuous pipe in the extended reach horizontal section of the oil or natural gas wells. Transportation is a limitation because the tubing cannot be divided into multiple loads. A practical mechanical limitation of pushing the coiled tubing into the well exists when the friction in the horizontal section of the wellbore exceeds the buckling force limit of the continuous tubing. Due to the inherent requirement to be stored on a storage reel, coiled tubing cannot be rotated in order to reduce friction while moving axially and to stir cuttings and debris from the lower side of the wellbore into the annular area where circulating fluid can carry it up-hole.

A method of forcing segmented oil field tubulars into a wellbore is to use what is commonly known as hydraulic snubbing jack technology. Generally, a snubbing jack consists of stationary slips and travelling slips that are connected to hydraulic cylinders to push sections of the pipe repetitively into the wellbore by taking multiple strokes of various lengths. The force that a snubbing jack can apply is limited because the distance between the stationary slip and the travelling slip creates an unsupported column length of the oil field tubular that increases the risk of buckling the tubular. Due to the constant start and stop repetitive movements of using a snubbing jack to move the pipe, it is difficult to circulate fluid through the pipe while moving. The repetitive movements of the snubbing jack are operated manually up to thousands of times per well that is being serviced creating the high possibility of human error resulting in an operational safety risk.

There is a demonstrated need in the industry to rotate a tubular string while pushing, forcing, snubbing, or stripping into or controlling when pulling while resisting wellbore pressures, a tubular string out of wells that may be under pressure to reduce the friction of axially moving the tubular string in extended reach horizontal wells to overcome the limitations of continuous coil tubing injector technology.

There is a further demonstrated need in the industry to reduce or eliminate the risk of buckling or bending an unsupported length of a tubular string being forced into a well under pressure.

There is further a demonstrated need in the industry to automate the operation of forcing or snubbing of the tubular string into or out of wells under pressure to overcome the safety risks of thousands of repetitive manually controlled movements of the snubbing jack technology. One example of a tubing injector directed toward these operations is disclosed in international patent application no. PCT/CA2019/050078 filed on 22 Jan. 2019, which is incorporated by reference into this application in its entirety. One issue that can arise with this type of tubing injector is that the tubing can comprise tapered upset ends that are larger in diameter than the nominal diameter of the tubing itself, wherein the tapered upset ends are adjacent to tubing coupling components or element that are further larger in diameter than the tapered upset ends. The larger diameter upset tapered ends may not be large enough to cause the jaws of the gripper blocks of the above-mentioned tubing injector to open but can still be large enough to jam or get stuck in the jaws and, therefore, cause the tubing injector to stop operating.

It is, therefore, desirable to provide an apparatus and method that overcomes this problem.

SUMMARY

This disclosure is related to improvements to the method and system of retracting the gripper block elements of the rotating jointed tubing injector patent application to accommodate the variations that exist within segmented pipe and tube diameter profiles directly adjacent to interconnecting couplings or tool joints within a tubing or pipe string, as disclosed in international patent application no. PCT/CA2019/050078 filed on 22 Jan. 2019, which is incorporated by reference into this application in its entirety. A system and method for injecting segmented pipe or tubing into and out of a well is provided. In some embodiments, the system can comprise a passively rotating jointed tubular string continuous snubbing injector ("injector") that can continuously apply a linear force into the tubular string while allowing the continuous rotation of a tubular string into and out of extended reach horizontal wellbores for the purposes of completing, working over, and servicing the wells.

In some embodiments, the injector can minimize the unsupported length of a tubular or tubular string by maintaining minimal and constant distance between the grippers of the injector that are gripping the tubular and the Blow Out Preventer (hereinafter called the "BOP") as the injector applies axial force to the tubular string into, or pulls the tubular string out of, the BOP and wellbore, thereby overcoming the limitations of the snubbing jack technology.

In some embodiments, the injector can comprise a mechanism that can apply a linear, constant force through the gripper blocks onto and over a certain length of the tubular and onto and over a certain length of a larger diameter coupling or tool joint connecting the segments of tubulars together while moving the tubulars axially into or out of the well and allowing simultaneous rotation of the tubular.

In some embodiments, the rotational force caused by the tubular string rotating can be transferred through the gripper mechanisms of the injector to the driven chains connected to the gripper blocks, and then to a stationary structure supporting and containing the injector, thereby minimizing rotational forces applied to the well head.

In some embodiments, the stationary structure supporting and containing the injector can provide further support for the weight of the tubular string suspended in the wellbore when that tubular string is held by pipe slips supported within the uppermost part of the stationary structure.

In some embodiments, a trigger mechanism can be disposed on the injector as means to retract the gripper blocks from contacting interconnecting couplings or tool joints disposed along the length of the tubing or pipe string as the tubing or pipe string is being injected into or retracted from the well. In some embodiments, the trigger mechanism can comprise a coupling sensor that can sense the location of a coupling component joining sections of tubing together wherein the trigger mechanism can cause the jaws of the gripper blocks adjacent to the tapered upset ends and coupling components to open up prior to the tapered upset ends and coupling components passing through the tubing injector so that no gripper blocks contact the tapered upset sections or coupling components. Once the tapered upset sections and coupling components are within the chains of the tubing injector, the trigger mechanism can retract so that the jaws of the subsequent gripper blocks of the tubing injector can continue contacting the tubing again.

Broadly stated, in some embodiments, a trigger mechanism can be provided for a tubing injector for forcibly injecting or retracting a tubular string axially into or out of a well, the tubing injector comprising an upper end and a lower end, the tubular string comprising a plurality of oil field tubulars connected together with tubular connecting elements, the tubing injector comprising a plurality of gripping elements attached to at least two drive chains wherein the tubular string is disposed between the at least two drive chains, the at least two drive chains substantially parallel to each other, the plurality of gripping elements configured to make contact and apply radial force to the tubular string, the tubular connecting elements having a larger diameter than the tubulars, the tubulars comprising a tapered upset section adjacent to the tubular connecting elements, the tapered upset section comprising an upset diameter that is greater in diameter than the tubulars but less than the diameter of the tubular connecting elements, the trigger mechanism comprising: at least one trigger assembly disposed between the at least two drive chains wherein each of the at least one trigger assembly is configured to prevent the plurality of gripping elements from contacting the tubular connecting elements; and a coupling sensor configured to sense the tapered upset section and the tubular connecting elements when the tubular string is being injected into or retracted out of the well.

Broadly stated, in some embodiments, the at least one trigger assembly can comprise: a substantially vertical frame; a wedge disposed on the frame, wherein the wedge is disposed substantially equidistant from each of the at least two drive chains, the wedge configured to prevent the plurality of gripping elements from contacting the tapered upset section of the tubulars or the tubular connecting elements; and a linear actuator configured to move the wedge in a substantially vertical direction relative to the frame wherein the wedge prevents the plurality of gripping elements from contacting the tubular connecting elements.

Broadly stated, in some embodiments, the trigger mechanism can further comprise a first pair of the at least one trigger assembly wherein the tubular string is disposed between the first pair of the at least one trigger assembly.

Broadly stated, in some embodiments, the first pair of the at least one trigger assembly can be configured to operate when the tubular string is being injected into the well.

Broadly stated, in some embodiments, the first pair of the at least one trigger assembly can be disposed by the upper end of the tubing injector.

Broadly stated, in some embodiments, the trigger mechanism can further comprise a second pair of the at least one trigger assembly wherein the tubular string is disposed between the second pair of the at least one trigger assembly.

Broadly stated, in some embodiments, the second pair of the at least one trigger assembly can be configured to operate when the tubular string is being retracted out of the well.

Broadly stated, in some embodiments, the second pair of the at least one trigger assembly can be disposed by the lower end of the tubing injector.

Broadly stated, in some embodiments, the trigger mechanism can further comprise a plurality of the wedge configured to engage pairs of the plurality of gripping elements thereby causing the pairs of the plurality of gripping elements to open and not contact or grip the tapered upset section and the tubular connecting elements as the tubular string is being injected into or retracted out of the well.

Broadly stated, in some embodiments, the linear actuator can be configured to extend and retract the wedge relative to the frame.

Broadly stated, in some embodiments, the linear actuator can comprise one or more of a hydraulic linear actuator, pneumatic linear actuator and an electric linear actuator.

Broadly stated, in some embodiments, the coupling sensor can comprise an electrical switch and a sensing toggle operatively coupled thereto.

Broadly stated, in some embodiments, the sensing toggle can be configured to rotate when contacted by the tapered upset section of the tubulars when the tubular string is being injected into or retracted out of the well.

Broadly stated, in some embodiments, the coupling sensor can comprise a first coupling sensor configured to detect when the tapered upset section and the tubing connecting elements are about to enter the tubing injector when the tubing string is being injected into the well.

Broadly stated, in some embodiments, the first coupling sensor can be disposed by the upper end of the tubing injector.

Broadly stated, in some embodiments, the coupling sensor can comprise a second coupling sensor configured to detect when the tapered upset section and the tubing connecting elements are about to enter the tubing injector when the tubing string is being retracted from the well.

Broadly stated, in some embodiments, the first coupling sensor can be disposed by the lower end of the tubing injector.

Broadly stated, in some embodiments, the trigger mechanism can further comprise a control system operatively coupled to the at least one trigger assembly and to the coupling sensor.

Broadly stated, in some embodiments, the control system can comprise one or more of a general purpose computer, a microcontroller, a microprocessor and a programmable logic controller.

Broadly stated, in some embodiments, the trigger mechanism as described herein can be used for injecting a tubing string into a well, and for retracting the tubing string from the well.

DETAILED DESCRIPTION OF EMBODIMENTS

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the present technology can include a variety of combinations and/or integrations of the embodiments described herein.

Figure 1:
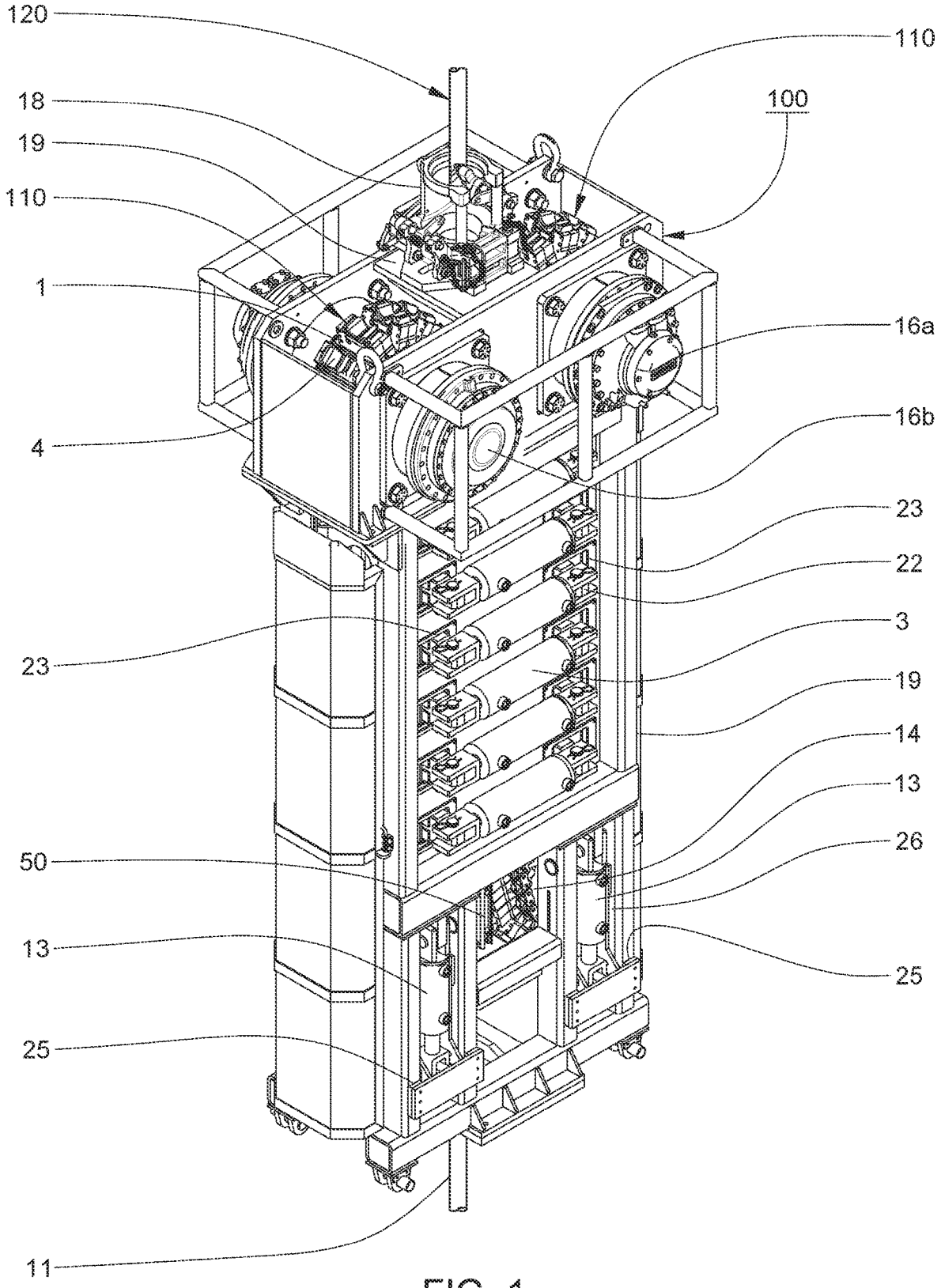
FIG. 1 is an isometric view depicting an injector assembly, further depicting the injector, chains, drives, grippers, tensioners, trigger mechanisms and supporting structure of the injector.

Referring to FIG. 1, an embodiment of injector (100) is shown. In some embodiments, drive chain links (1) and gripper block assemblies (4) can be interconnected to form two continuous counter-rotating chain assemblies (110). Each chain assembly (110) can be driven by a motor (16*a*) and can be held by a brake (16*b*). Gripper block assemblies (4) can be attached to drive chain links (1) that can be acted upon by a plurality of squeeze cylinders (3) that can apply a transverse force to cause the counter-rotating drive chain assemblies (110) to move towards each other thereby forcibly engaging gripper block assemblies (4) with the outer diameter of tubing (11) and the larger outer diameter of a coupling, tool joint or other connecting element connecting segments of tubular string (120). In some embodiments, the squeeze cylinders (3) can act upon pressure beam shafts (22) that pass through the ends of the squeeze cylinders (3), slotted holes (23) on the injector housing (19) and the pressure beams (2) as shown, for example, in FIG. 2. In some embodiments, chain tension hydraulic cylinders (13) can apply vertical force to idler sprocket shaft (14) to adjust the drive chain length as the chain components wear or as the diameter of tubular string (120) varies in diameter. The tensioner shafts can be guided vertically by sliders (25) moving within slots (26) in the injector housing (19). In some embodiments, trigger mechanisms (50) can be mounted between the gripper block assemblies (4) to cause the gripper block jaws to retract into the gripper block housings when a coupler or a section of tubular string (120) with larger diameter passes through. In some embodiments, slip support structure (18) can be installed on top of the main housing (19) to provide a method of supporting tubular string (120) when it is not supported by injector (100), or by another structure.

Figure 2:
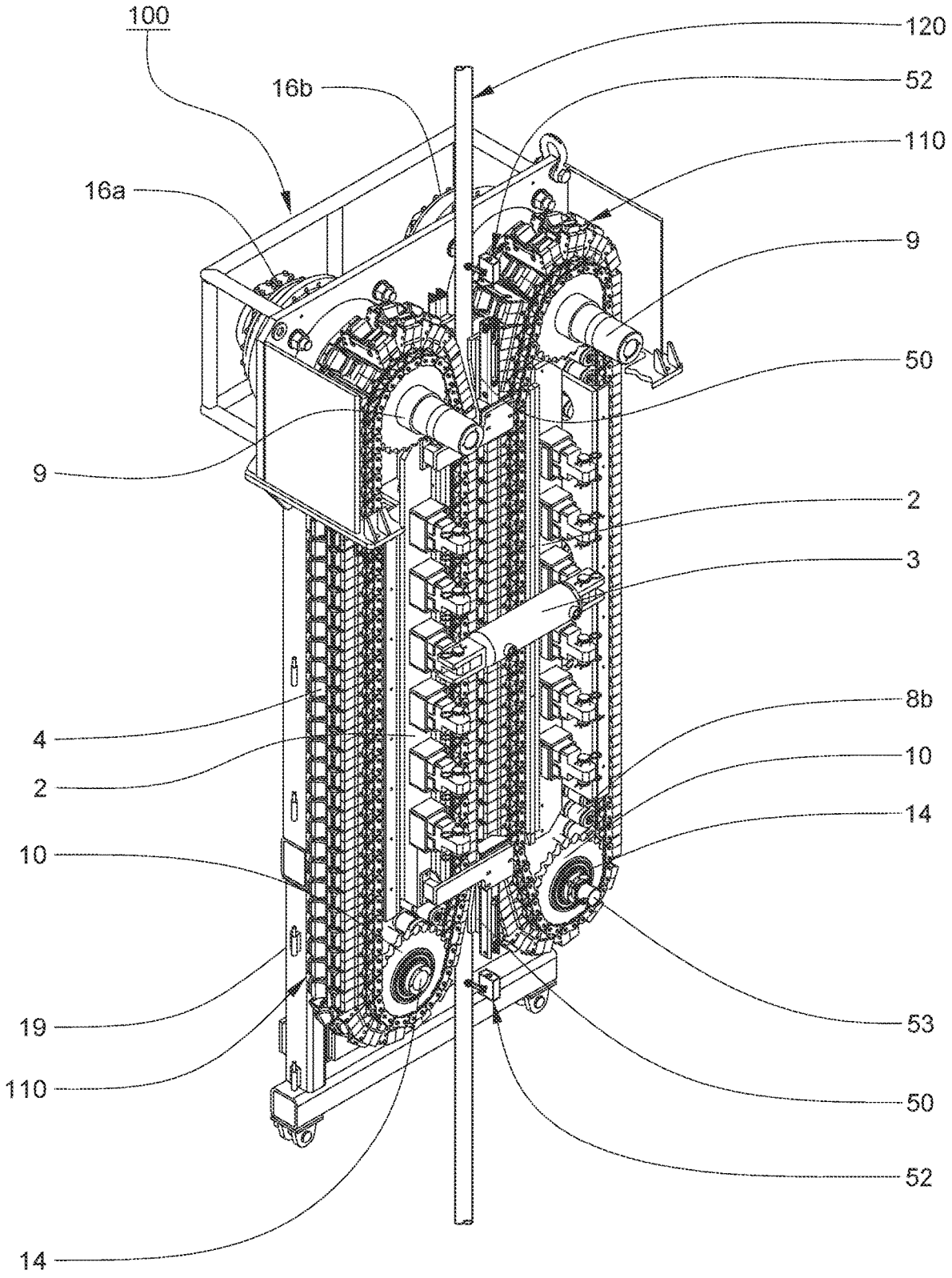
FIG. 2 is an isometric view depicting an injector assembly of FIG. 1 with part of the outer housing removed to allow a view of the internal workings.

FIG. 2 is an isometric view of the injector of FIG. 1 with part of the injector housing (19), some of the squeeze cylinders (3), one motor (16*a*) and one brake (16*b*) removed to expose the inner workings of the injector (100). The chain assemblies (110) can be engaged on drive sprocket assemblies (9) at the top and idler sprocket shafts (14) and idler sprockets (10) that can move vertically to maintain chain tension as the pressure beams (2) are acted upon by the squeeze cylinders (3). In some embodiments, gripper block assemblies (4) can be supported by rolling elements (8*b*) that can be acted upon by pressure beams (2) to force counter-rotating chain assemblies (110) towards each other, and to force gripper block assemblies (4) onto tubular string (120). In some embodiments, trigger mechanisms (50) can be mounted between the gripper block assemblies to cause the gripper block jaws to retract into the gripper block housings when a coupler or a section of tubular string (120) with a larger diameter passes through. In some embodiments, injector (100) can be contained within main housing (19) that can be mounted to a wellhead, lubricator, or BOP supplied by others. In some embodiments coupling sensors (52) can be deployed to sense the presence of the larger diameter section of the tubular string (120). In some embodiments, an encoder (53) may be disposed on an idler shaft (14).

Figure 3:
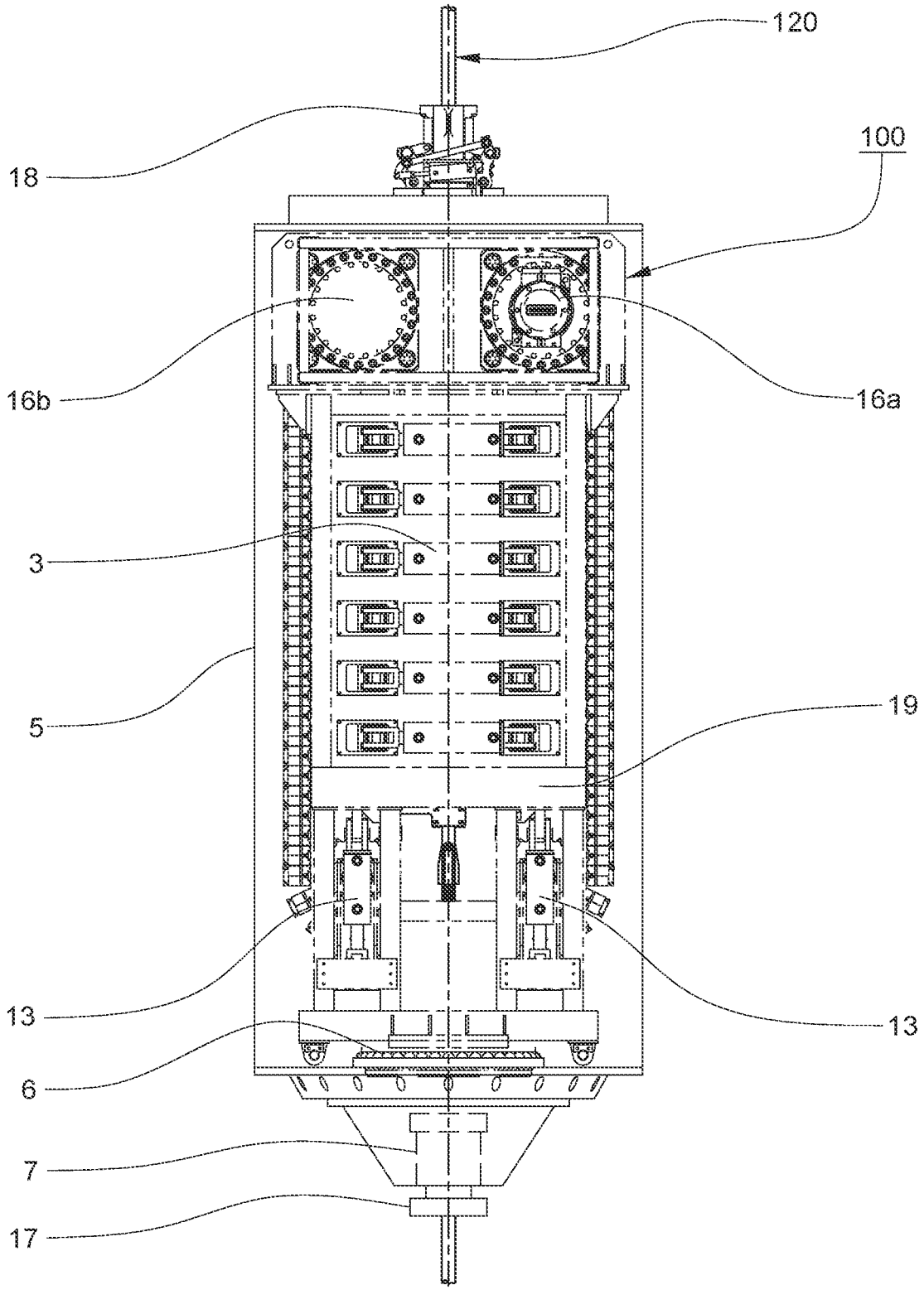
FIG. 3 is a front elevation cross-section view depicting an injector assembly of FIG. 1 mounted within an outer housing, further depicting the injector supported by a bearing assembly and an outer housing and a rotary seal assembly.

In some embodiments, injector (100) can be mounted within outer support structure (5), as shown in FIG. 3. In some embodiments, injector (100) can be contained within main housing (19) that can be rotatably mounted on bearings (6) within outer support structure (5). Pressurized hydraulic fluid can be ported through rotary swivel (7) and into hydraulic squeeze cylinders (3), hydraulic drive motors (16*a*), hydraulic brakes (16*b*) and chain tension cylinders (13). Outer support structure (5) can be supported on a mounting flange (17) attached to a wellhead, lubricator, or BOP supplied by others. In some embodiments, slip support structure (18) can be installed within the uppermost area of outer support structure (5) to provide a method of supporting tubular string (120) when it is not supported by injector (100), or by another structure.

Figure 4:
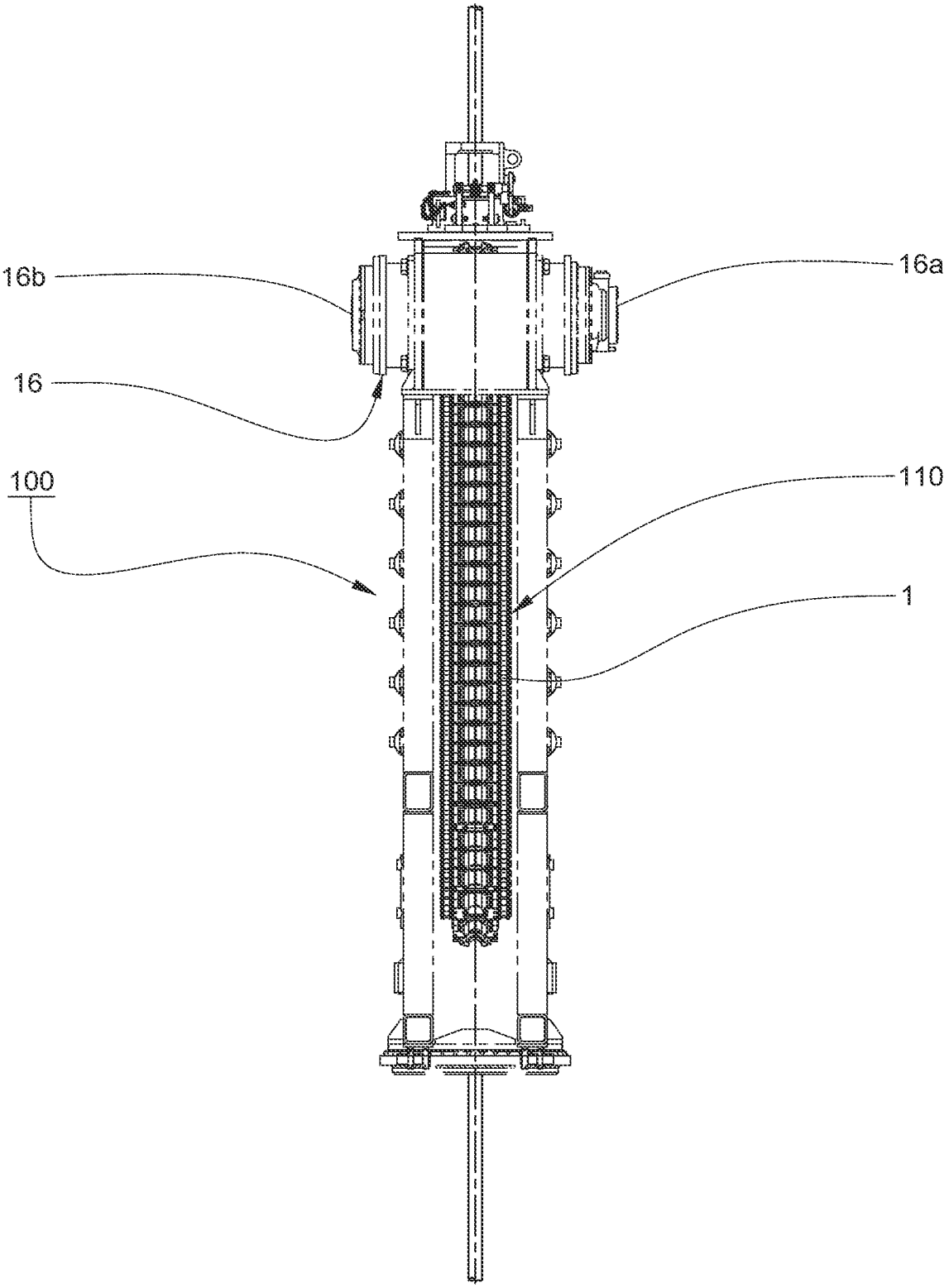
FIG. 4 is a side elevation cross-section view depicting the injector of FIG. 2, further depicting the injector, chain drives and supporting structure of the injector.

FIG. 4 illustrates a side elevation view of the injector (100) showing hydraulic motor assemblies (16), comprised of hydraulic drive section (16*a*) and hydraulic brake section (16*b*), which can apply rotational force and speed to drive chain assemblies (110) and chain links (1) (as shown in FIG. 1).

Figure 5:
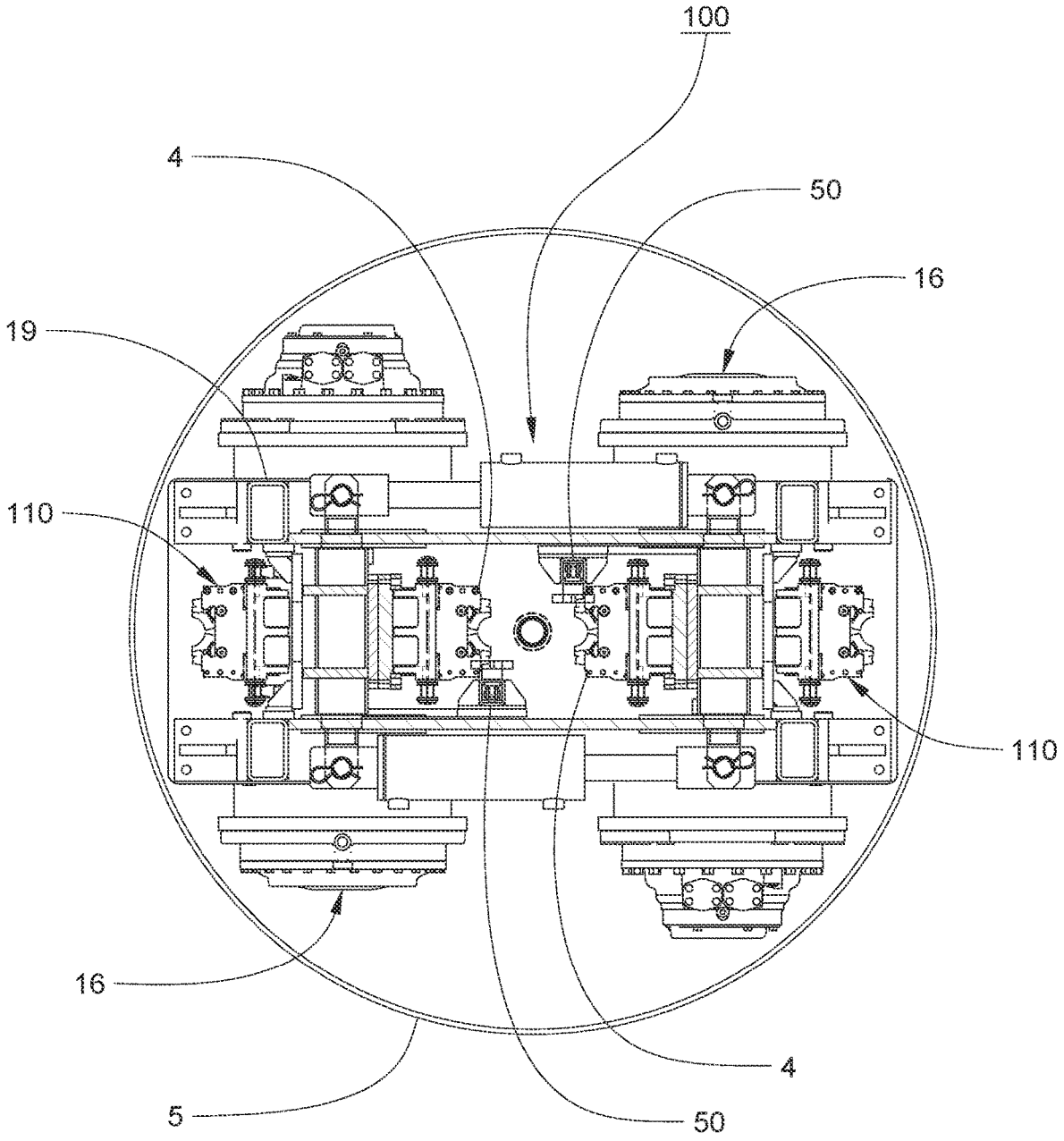
FIG. 5 is a top plan section view depicting the hydraulic motor assemblies, squeeze cylinder assembly, trigger mechanisms and the grippers of the injector of FIG. 3.

FIG. 5 illustrates a top plan section view of injector (100) showing gripper block assemblies (4) and trigger assemblies (50) at a stand-by position to create a larger opening between the chain assemblies (110) for downhole tools or wellhead components to be passed through. The fitment of main housing (19) and drive motor assemblies (16) are shown in relation to outer support structure (5) to illustrate how the injector (100) can rotate within the outer support structure (5).

Figure 6:
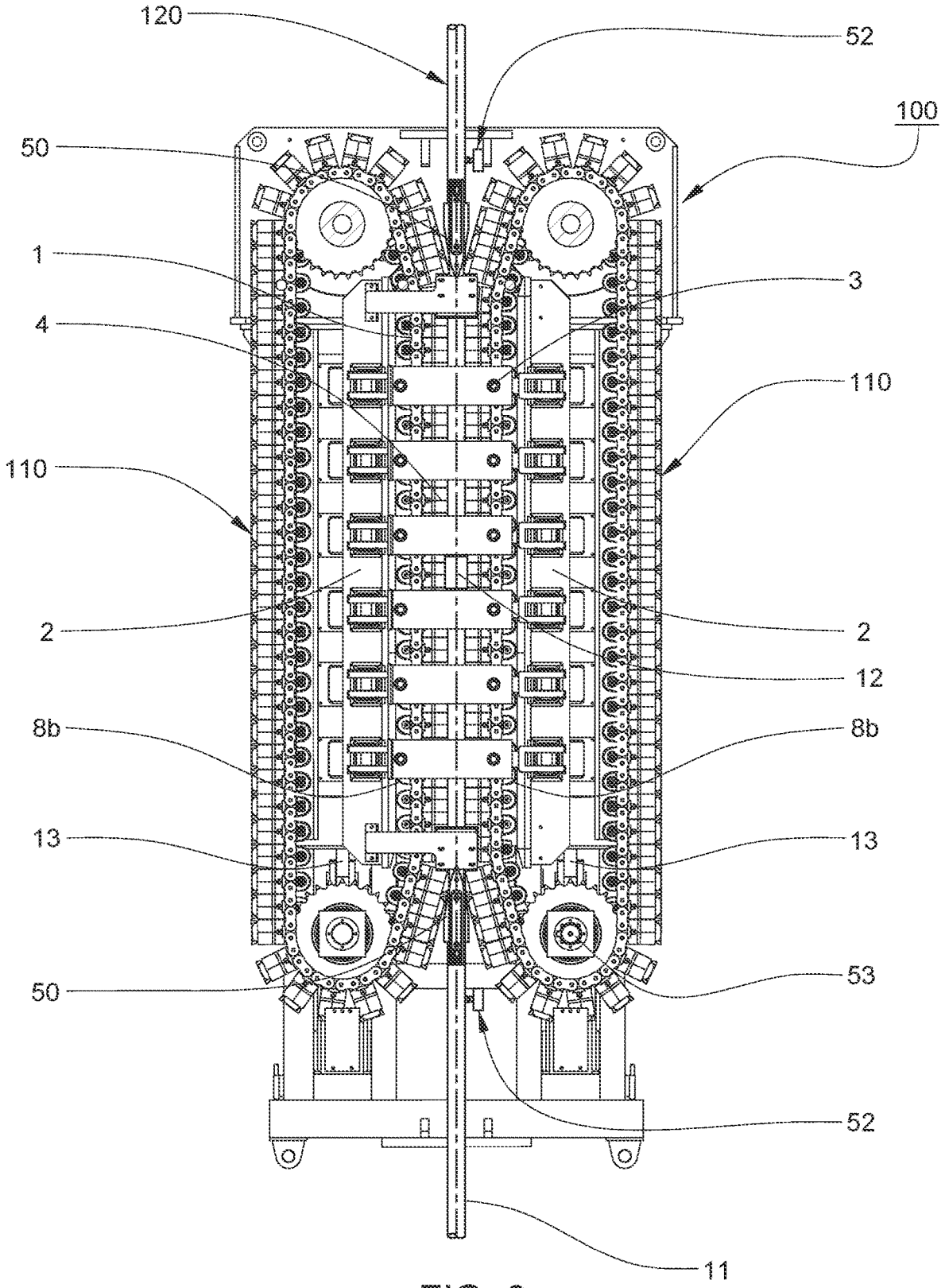
FIG. 6 is a front elevation view depicting the injector, grippers, chain drives, trigger mechanisms and supporting structure of the injector of FIG. 2 in an operating mode of operation.

FIG. 6 illustrates a front elevation section view that shows the hydraulic squeeze assembly, comprising of pressure beams (2), rolling elements (8*b*), and hydraulic squeeze cylinders (3) retracted in order to cause drive chain links (1) and gripper block assemblies (4) to engage the outer diameter of tubing string (11) and the larger outer diameter of a coupling, a tool joint or another connecting element, labelled as (12) in the figure, connecting segments of tubular string (120) in an operating mode. Chain tension cylinders (13) can retract to maintain tension on the chain assemblies (110) as the squeeze cylinders (3) retract to pull the grippers (4) towards each-other, in order to engage the tubing string (120). Trigger mechanisms (50) are shown at the point where the gripper blocks come together to come in contact with the tubular string (120). Coupling sensors (52) are shown positioned at the top and bottom of the injector (100) to sense the presence of the larger outer diameter of a coupling, a tool joint or another connecting element (12). An encoder (53) is shown on one of the idler sprocket shafts (14).

Figure 7:
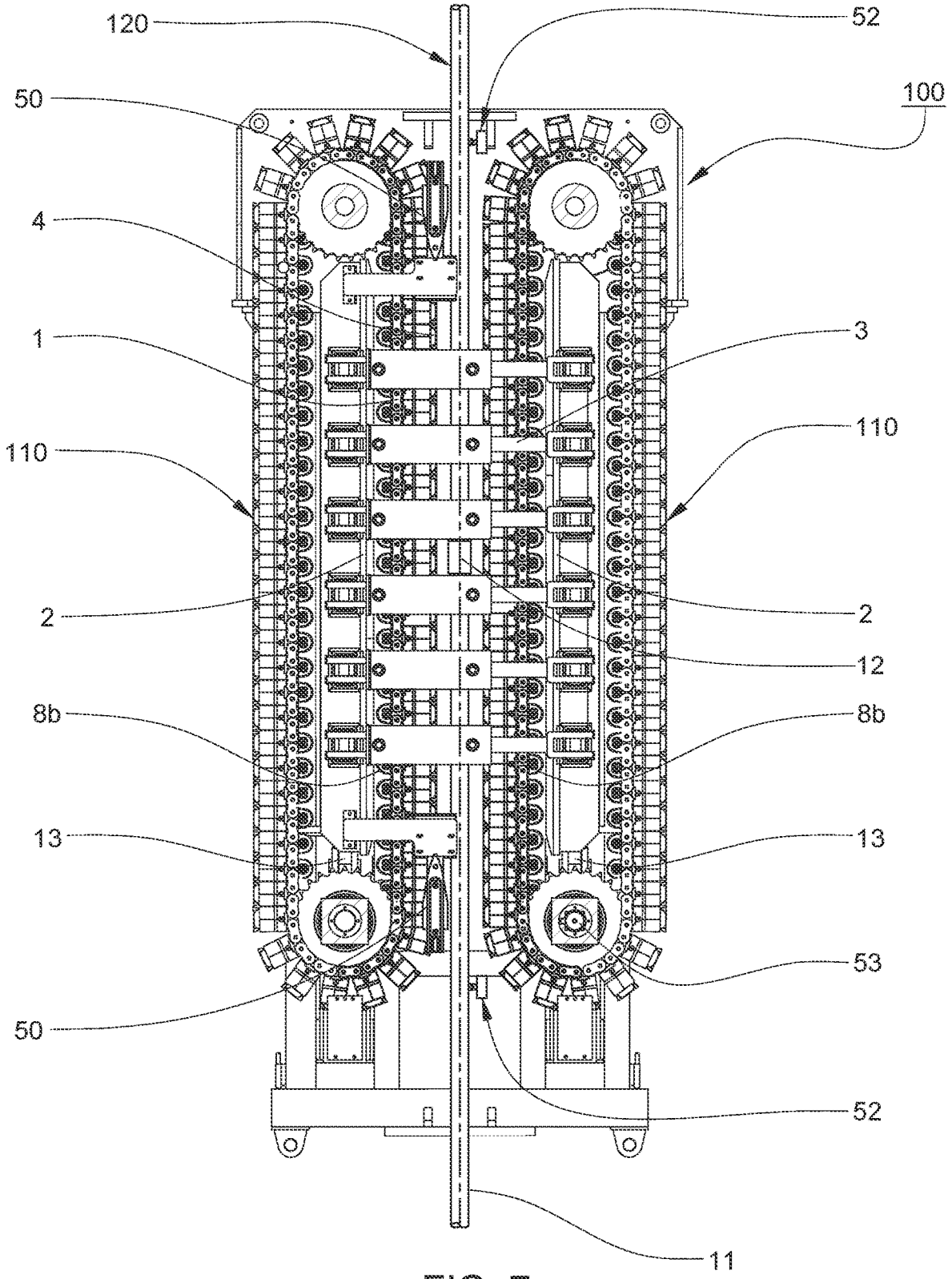
FIG. 7 is a front elevation view depicting the injector, grippers, chain drives, trigger mechanisms, and supporting structure of the injector of FIG. 2 in a standby mode of operation.

FIG. 7 illustrates a front elevation section view that shows the hydraulic squeeze assembly, comprising of pressure beams (2), rolling elements (8*b*), and hydraulic squeeze cylinders (3) extended in order to cause drive chain links (1) and gripper block assemblies (4) and trigger assemblies (50) to dis-engage the outer diameter of tubing (11) and the larger outer diameter of a coupling, a tool joint or another connecting element, labelled as (12) in the figure, connecting segments of tubular string (120) in a non-operating, stand-by operating mode. Chain tension cylinders (13) can extend to maintain tension on the chain assemblies (110) as the squeeze cylinders (3) extend to push the grippers (4) away from each-other, in order to dis-engage the tubing string (120). Coupling Sensors (52) are shown positioned at the top and bottom of the injector (100) to sense the presence of the larger outer diameter of a coupling, a tool joint or another connecting element (12). An encoder (53) is shown on one of the idler sprocket shafts (14).

Figure 8:
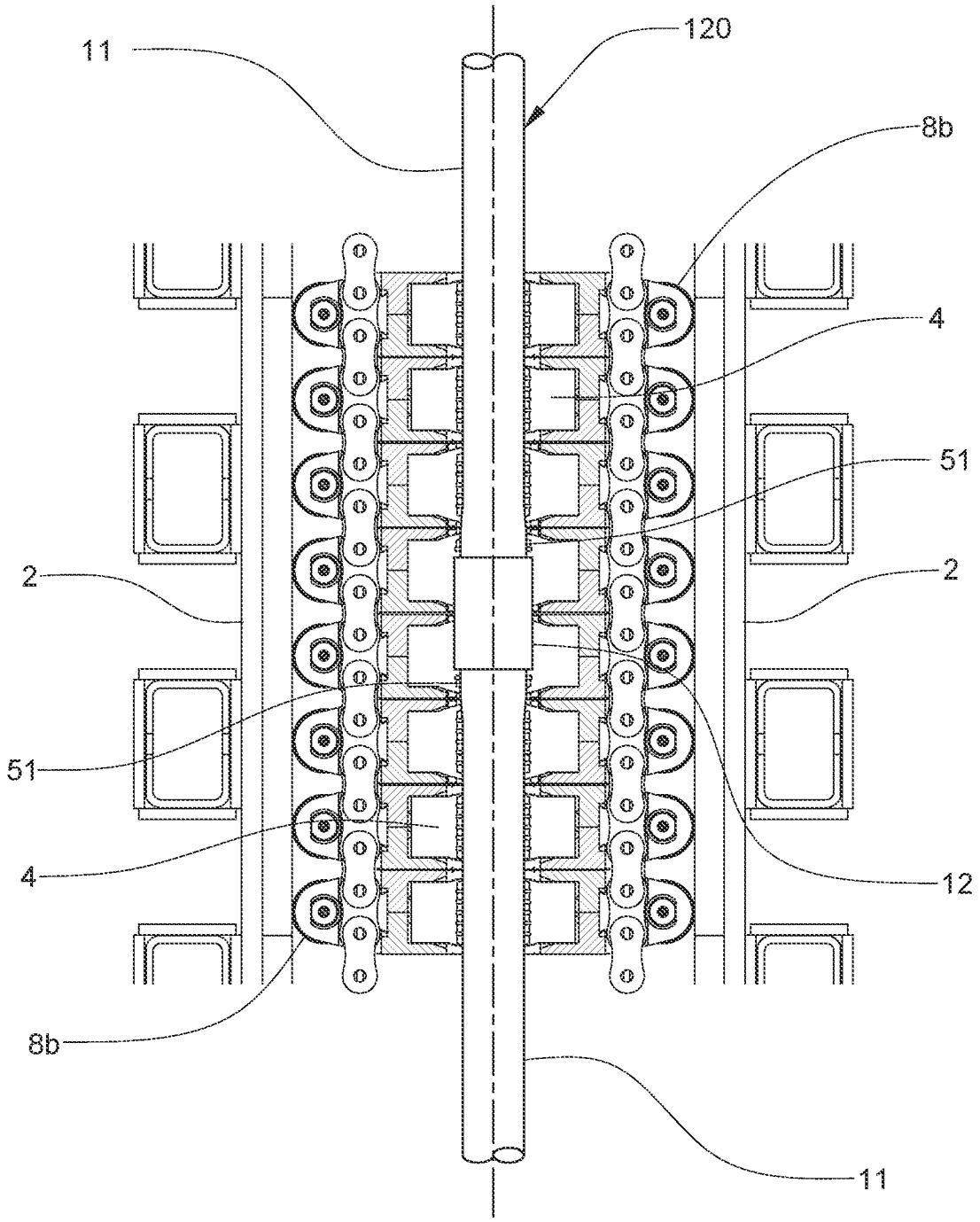
FIG. 8 is a front elevation detailed section view depicting the injector of FIG. 1 gripping a section of a tubular string comprising a tubing coupler.

Referring to FIG. 8, gripper block assemblies (4) are shown in an operating mode wherein gripper block assemblies (4) are in contact with and engaging the outer diameter of a tubular string (120) that can include tubing (11), which can further include a tapered upset section (51), and the larger outer diameter of coupler (12) that, for the purposes of this description, can comprise a tubing coupler, a tool joint or other type of tubular connecting element as well known to those skilled in the art for connecting segments of tubular string (120). In some embodiments, gripper block assemblies (4) can be supported by rolling elements (8*b*) that can be in rolling contact with pressure beams (2). In some embodiments, gripper block assemblies (4) can variably adjust to the larger diameter of coupler (12) connecting the segments of tubular string (120) while the rolling elements (8*b*) can remain in the same plane and have evenly distributed force on the pressure beam (2), in order to maintain constant force on tubular string (120).

Figure 9:
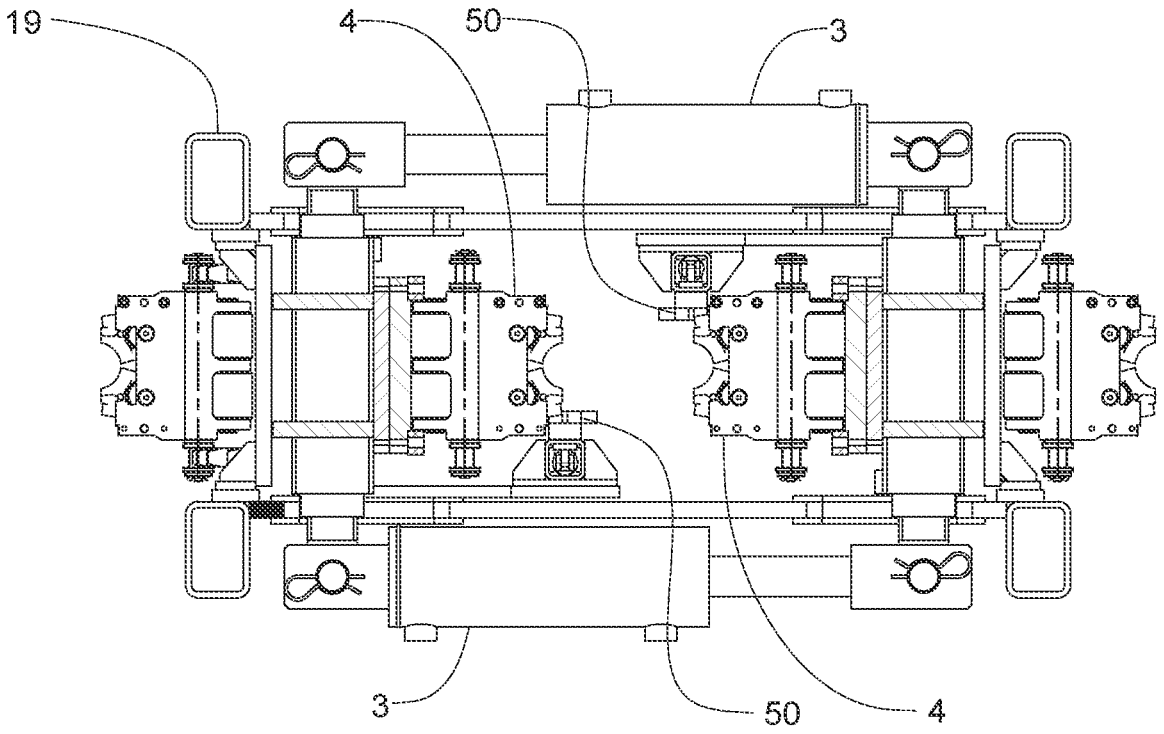
FIG. 9 is a top plan view depicting the trigger mechanisms and gripper block assemblies of the injector of FIG. 1 in a standby mode of operation.

Referring to FIG. 9, gripper block assemblies (4) and trigger assemblies (50) are shown positioned within main injector housing (19) to a stand-by position with the squeeze cylinders (3) fully extended that can create a pathway for downhole tools or wellhead components to be passed through.

Figure 10:
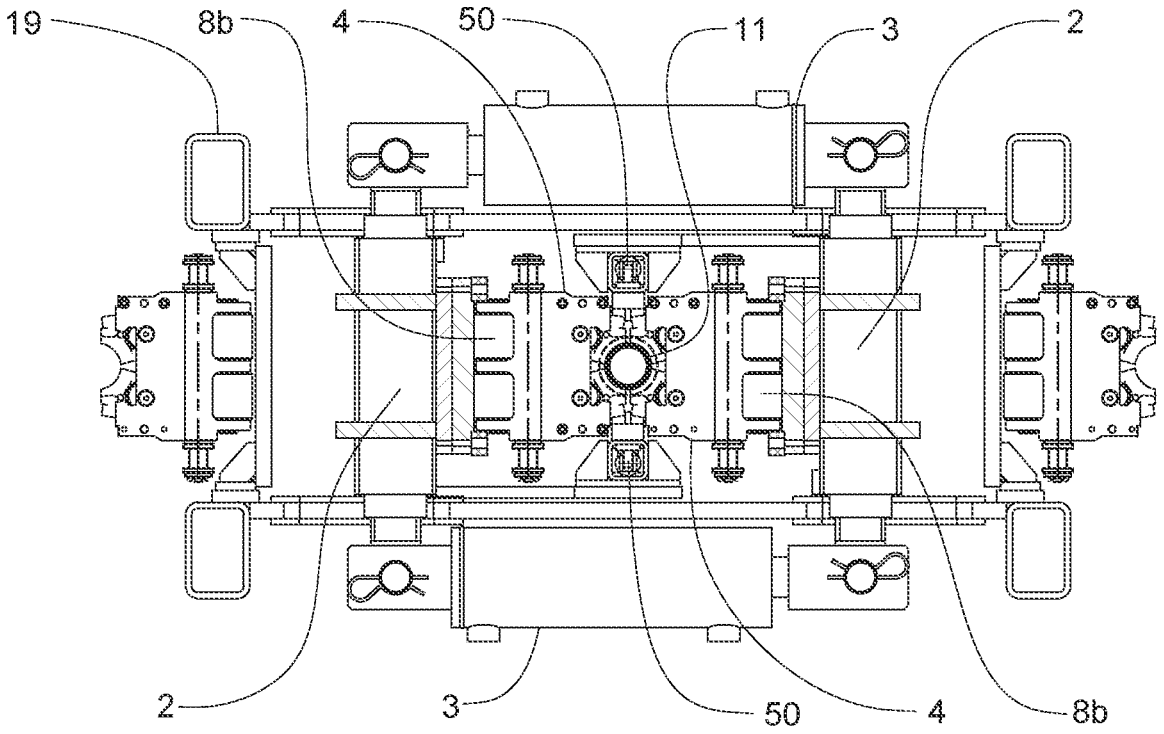
FIG. 10 is a top plan view depicting the gripper block assemblies of the injector of FIG. 1 in an operating mode of operation when operating on tubing.

In FIG. 10, gripper block assemblies (4) are illustrated to be positioned within main injector housing (19) in an operating mode with the squeeze cylinders (3) retracted, causing the pressure beams (2) to act upon the rolling elements (8*b*) of the gripper block assemblies (4), wherein gripper block assemblies (4) can be engaged onto tubing (11). Trigger assemblies (50) are between the gripper block assemblies (4).

Figure 11:
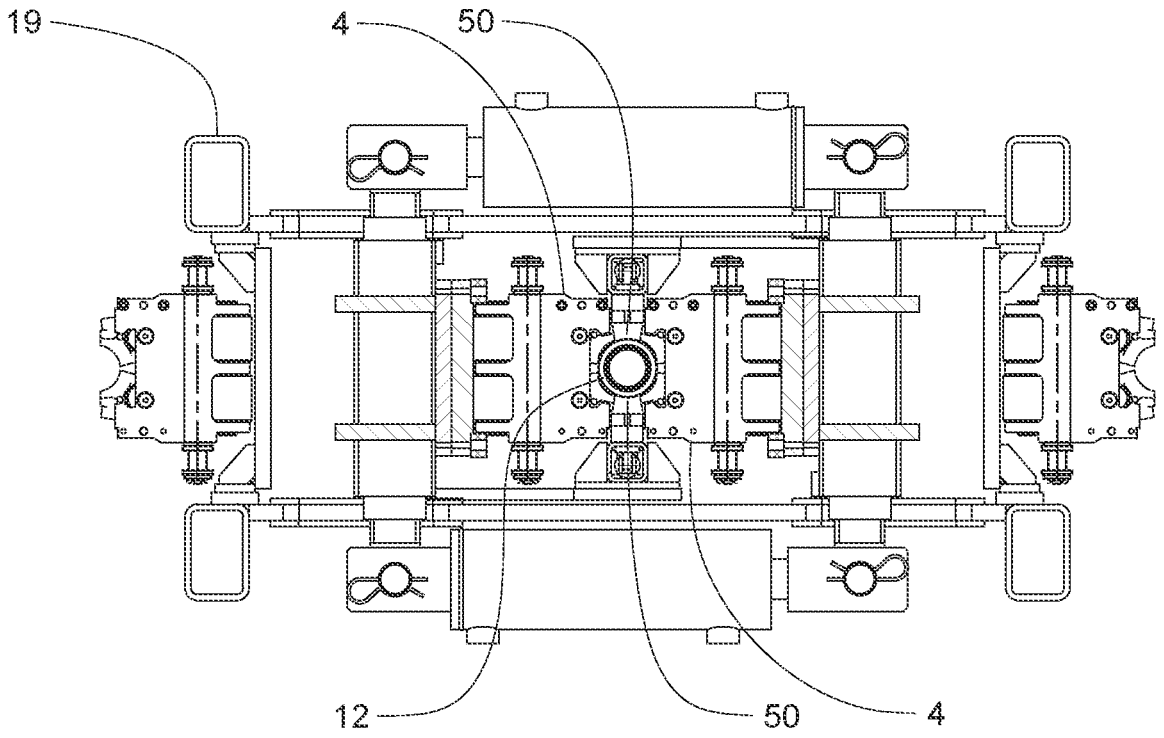
FIG. 11 is top plan view depicting the gripper block assemblies of the injector of FIG. 1 in an operating mode of operation when operating on a tubular connector.

In FIG. 11, gripper block assemblies (4) are illustrated to be positioned within main injector housing (19) in an operating mode in which gripper block assemblies (4) can engage coupler (12). Trigger assemblies (50) are disposed between the gripper block assemblies (4).

Figure 12:
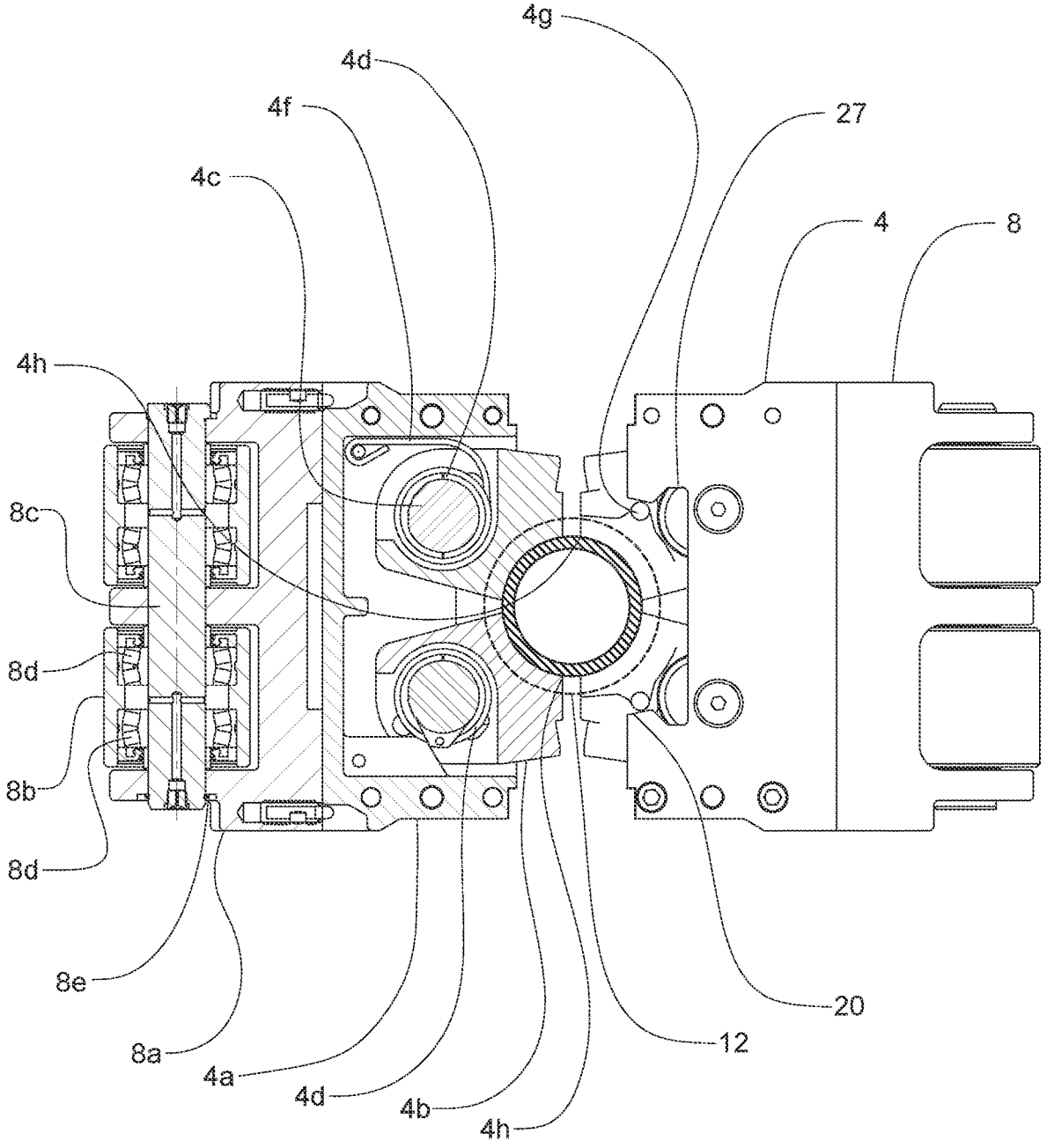
FIG. 12 is a top plan partial section view depicting the gripper block of the injector of FIG. 1 in full contact with a tubular.

FIG. 12 shows a detailed view of one embodiment of gripper block assembly (4) and carrier assembly (8) in a top plan section view and full top view. In some embodiments, carrier assembly (8) can comprise carrier body (8*a*), roller (8*b*) rotatably disposed on shaft (8*c*) via bearings (8*d*) wherein shaft (8*c*) can be retained in carrier body (8*a*) with retaining rings (8*e*) disposed on one or both ends of shaft (8*c*). In some embodiments, gripper block assembly (4) can comprise of two grippers (4*b*) that can be connected to eccentric shaft (4*c*) with split bushings (4*d*). Eccentric shaft (4*c*) can rotate inside of each of the two housing halves (4*a*), which can be bolted together. In some embodiments, gripper (4*b*) can comprise a pivot pin (4*g*) that can contact the housing halves (4*a*) at a protruding surface (20) to act as a pivot point and force eccentric shaft (4*c*) to rotate when coupler (12) contacts outer corners (4*h*) of grippers (4*b*), which can move gripper (4*b*) out of the way of coupler (12). As the gripper (4*b*) moves away from the coupler (12), the shape of the eccentric shaft (4*c*) causes the pivot pin (4*g*) to follow the profile of the housing (4*a*) until it reaches a cavity (27), which causes the grippers (4*b*) to move away from each-other creating a space for the coupler (12) to exist while the rest of the gripper assembly (4) and the carrier assembly (8) stay in line. In some embodiments, spring (4*f*) can act on eccentric shaft (4*c*) to return eccentric shaft (4*c*) to the starting position when coupler (12) is no longer in contact with gripper (4*b*). In some embodiments, carrier assembly (8) and gripper block assembly (4) can be connected through mechanical means. In the illustrated embodiment, a dovetail mechanism can be used, which can allow the gripper block assembly (4) to be removed from the carrier assembly (8) to change sizes or replace worn or broken parts by sliding the gripper assembly sideways to disengage the dovetails.

Figure 13:
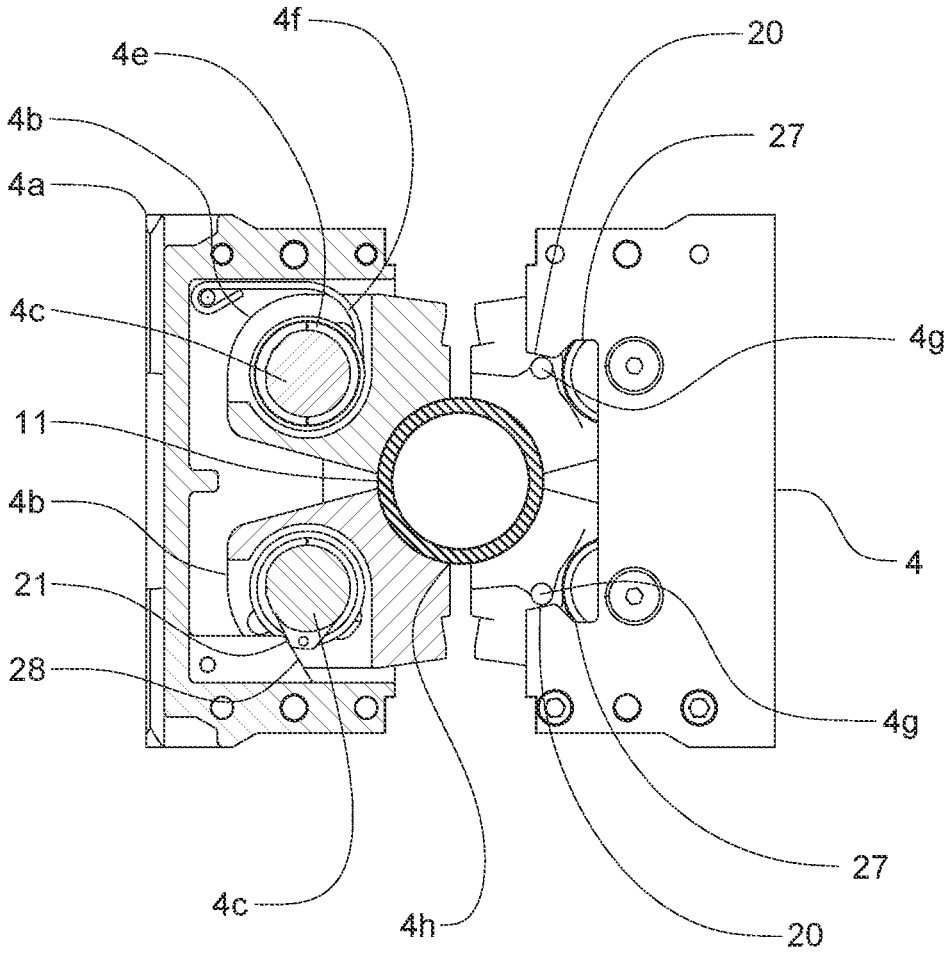
FIG. 13 is a top plan partial section view depicting the gripper block of the injector of FIG. 1 when tubing is fully contacted by a gripper block assembly.

FIG. 13 shows a detailed view of one embodiment of gripper block assembly (4) in a top plan section view and full top view and illustrates tubing (11) being contacted by gripper block assembly (4). In this figure, gripper block assembly (4) is being pushed towards tubing (11) thereby providing radial force (grip) that, in turn, allows axial force to be applied to tubing (11). Gripping elements (4*b*) can self-centralize against tubing (11). These gripping forces are transmitted through eccentric shaft (4*c*) and create a rotation that is resisted by a face (21) of the eccentric shaft (4*c*), making contact with a cast-in feature of the gripper housing (4*a*) which limits the distance the gripper block can move and make sure the eccentric shaft will not go too far and lock up. In the illustrated embodiment, the stopper can be part of eccentric shaft (4*c*) and can act against housing half (4*a*) on a face labelled (28), although those skilled in the art will appreciate that various alternative configurations exist that are substantially similar.

Figure 14:
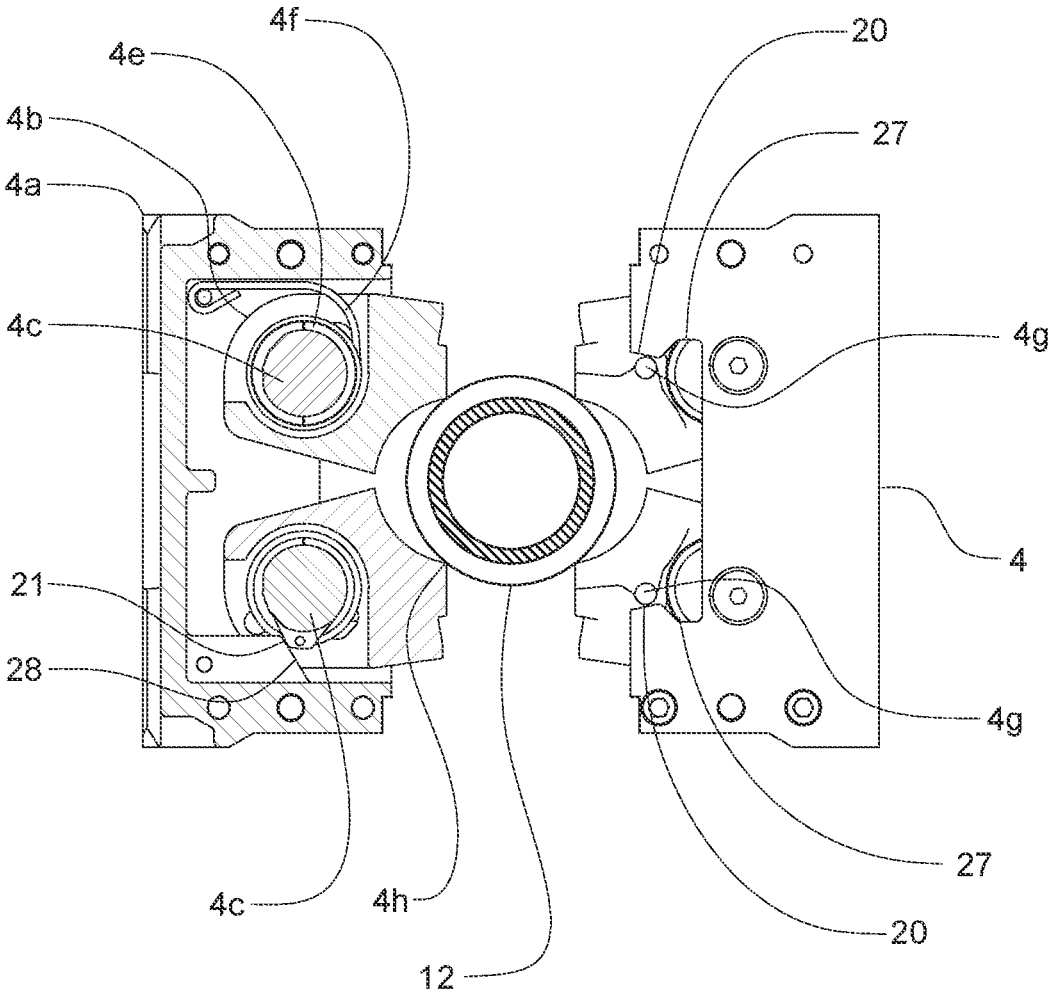
FIG. 14 is a top plan partial section view depicting the gripper block of the injector of FIG. 1 when the gripper block assembly starts to engage a tubing coupler.

FIG. 14 shows a detailed view of one embodiment of gripper block assembly (4) in a top plan section view and full top view and illustrates the gripper assembly (4) in a position where the edges (4*h*) of the grippers (4*b*) contact coupler (12) as the gripper assemblies (4) begin to come together. It can be seen that pivot pin (4*g*) can act as a pivot point for the gripper (4*b*) as it contacts surface (20) of the gripper housing (4*a*) causing the gripper (4*b*) to rotate away from the coupler (12).

Figure 15:
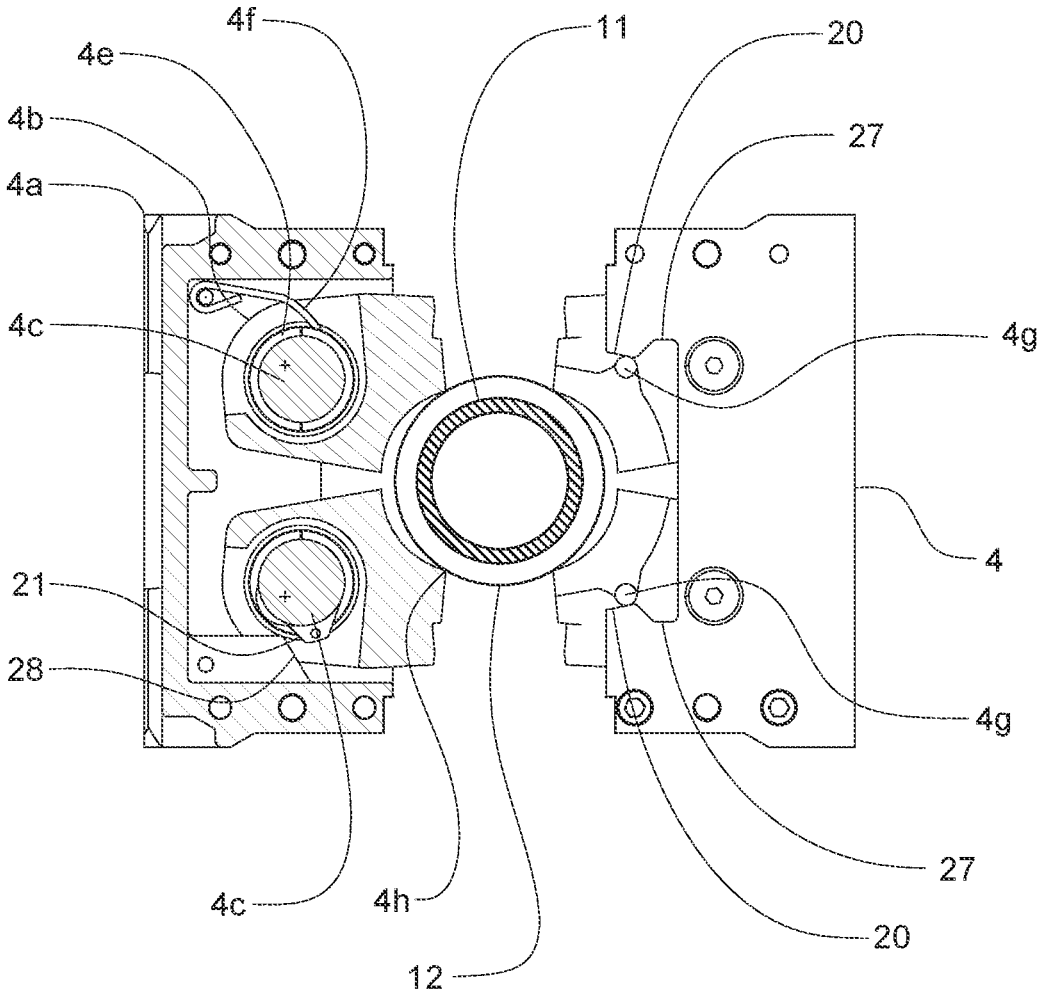
FIG. 15 is a top plan partial section view depicting the gripper block of the injector of FIG. 14 as the gripper block further engages the tubing coupler.

FIGS. 15 to 18 illustrate the progression of the various engagement modes between gripper block assembly (4) and coupler (12) as gripper block assemblies (4) progressively come together, thereby allowing gripping elements (4*b*) to open variably and allow larger diameter elements such as couplers (12) to pass through without interference. FIG. 15 illustrates gripper block assembly (4) closing further thereby causing gripping elements (4*b*) to rotate outwards as it pivots around pivot pin (4*g*) while engaging coupler (12). Pivot pin (4*g*) can impede the outward rotation of gripping elements (4*b*) by contacting surface (20) disposed on housing half (4*a*), therefore acting as a pivot point for rotation of gripping element (4*b*). Rotation around this pivot point can cause eccentric shaft (4*c*) to rotate and move gripping (4*b*) element outward, thereby creating clearance for coupler (12).

Figure 16:
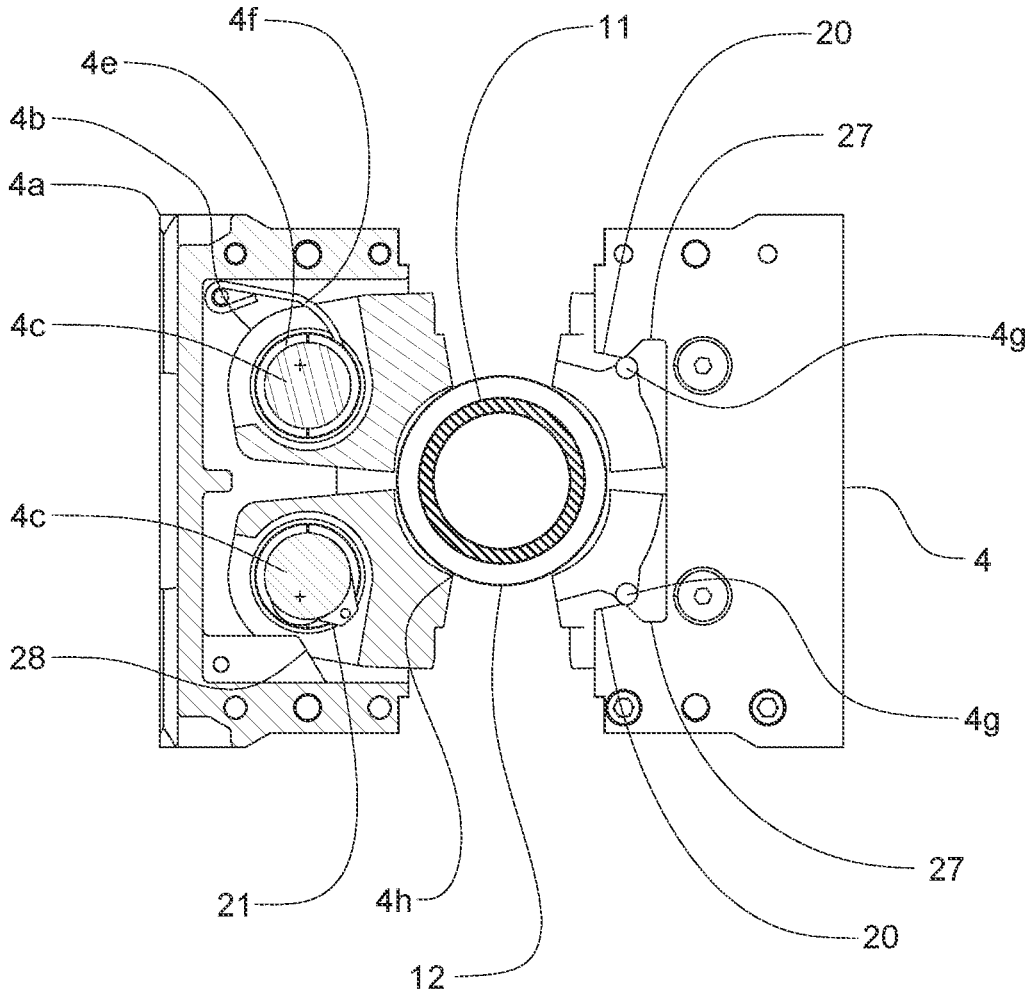
FIG. 16 is a top plan partial section view depicting the gripper block of the injector of FIG. 15 wherein the gripper block assembly is closing further on the tubing coupler.

FIG. 16 illustrates still further closing of gripper block assembly (4) and the corresponding movement of gripper element (4*b*) and eccentric shaft (4*c*). As the grippers (4*b*) move back, the pivot pin (4*g*) reaches the end of surface (20) on the main housing (4*a*).

Figure 17:
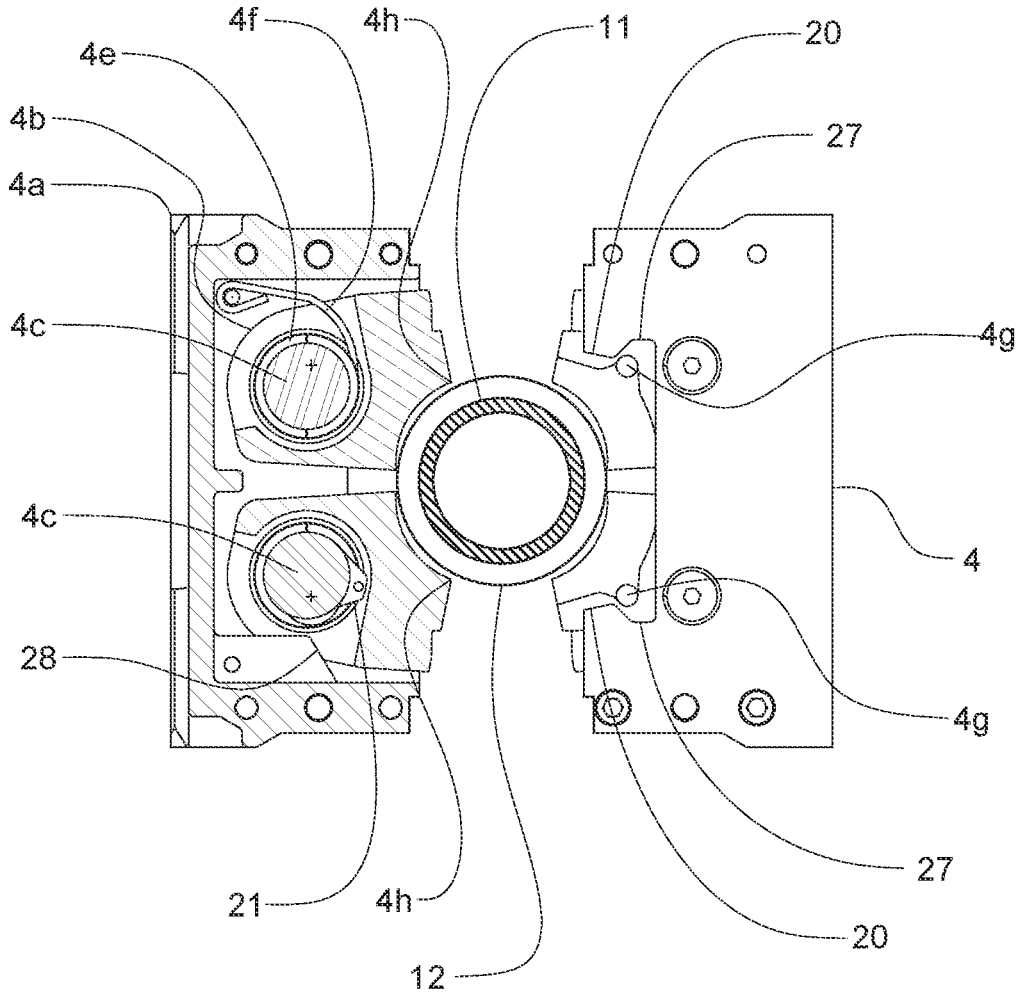
FIG. 17 is a top plan partial section view depicting the gripper block of the injector of FIG. 16 where the gripper block assembly is closing further still on the tubing coupler.

FIG. 17 illustrates further progression to a position where gripper block assembly (4) has closed almost completely and both leading edges (4*h*) of gripper elements (4*b*) have made contact with coupler (12). In this figure, pivot pin (4*g*) is no longer in contact with surface (20) on housing half (4*a*), thus, gripper element (4*b*) no longer rotates about pivot pin (4*g*) but, instead, has its movement driven by the face of coupler (12) as the pivot pin (4*g*) moves into a recess (27) in the main housing (4*a*). In this embodiment, return spring (4*f*) can prevent gripper elements (4*b*) from moving further away from the coupler (12) and forces gripper elements (4*b*) towards tubing (11).

Figure 18:
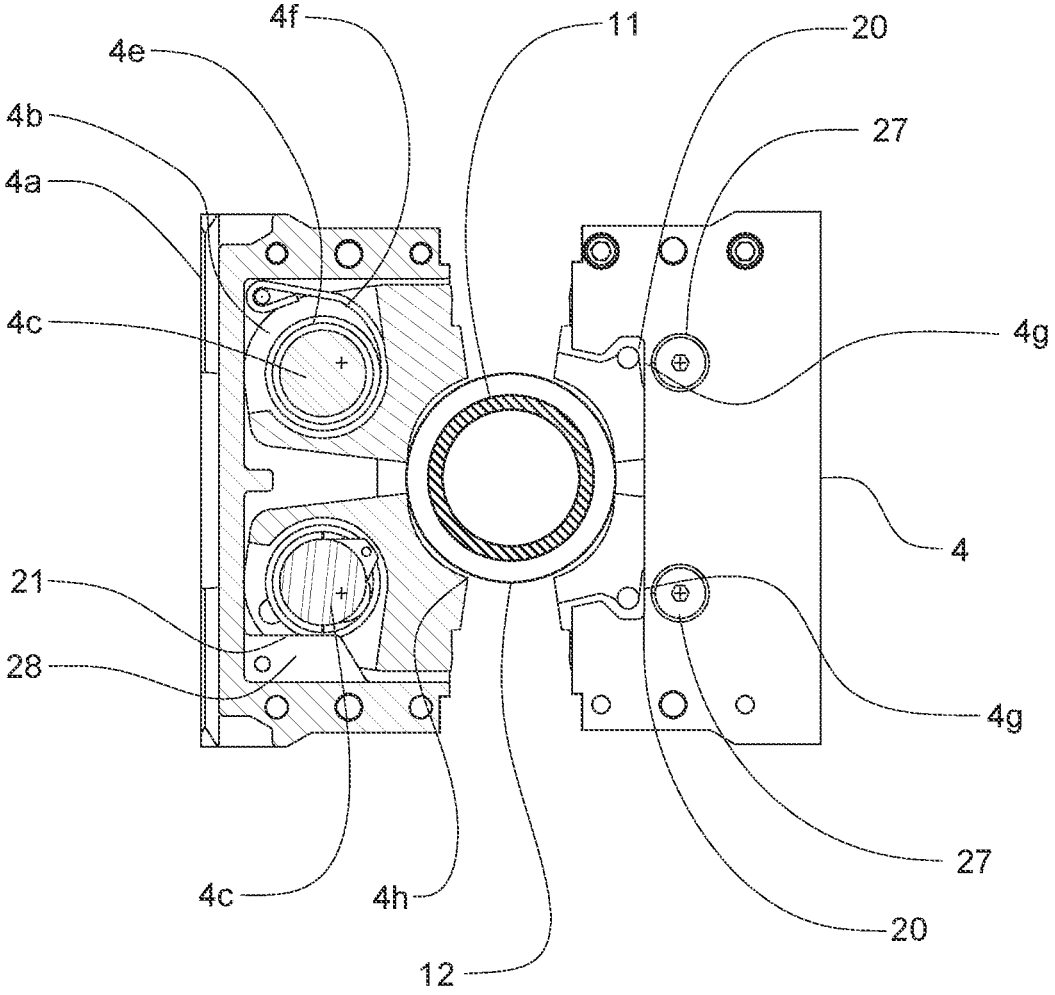
FIG. 18 is a top plan partial section view depicting the gripper block of the injector of FIG. 17 wherein the gripper block assembly has fully retracted around the tubing coupler.

FIG. 18 shows the final position of gripping elements (4*b*) when gripper block assembly (4) has fully closed around tubing (11), demonstrating that gripping elements (4*b*) have accommodated coupler (12).

Figure 19:
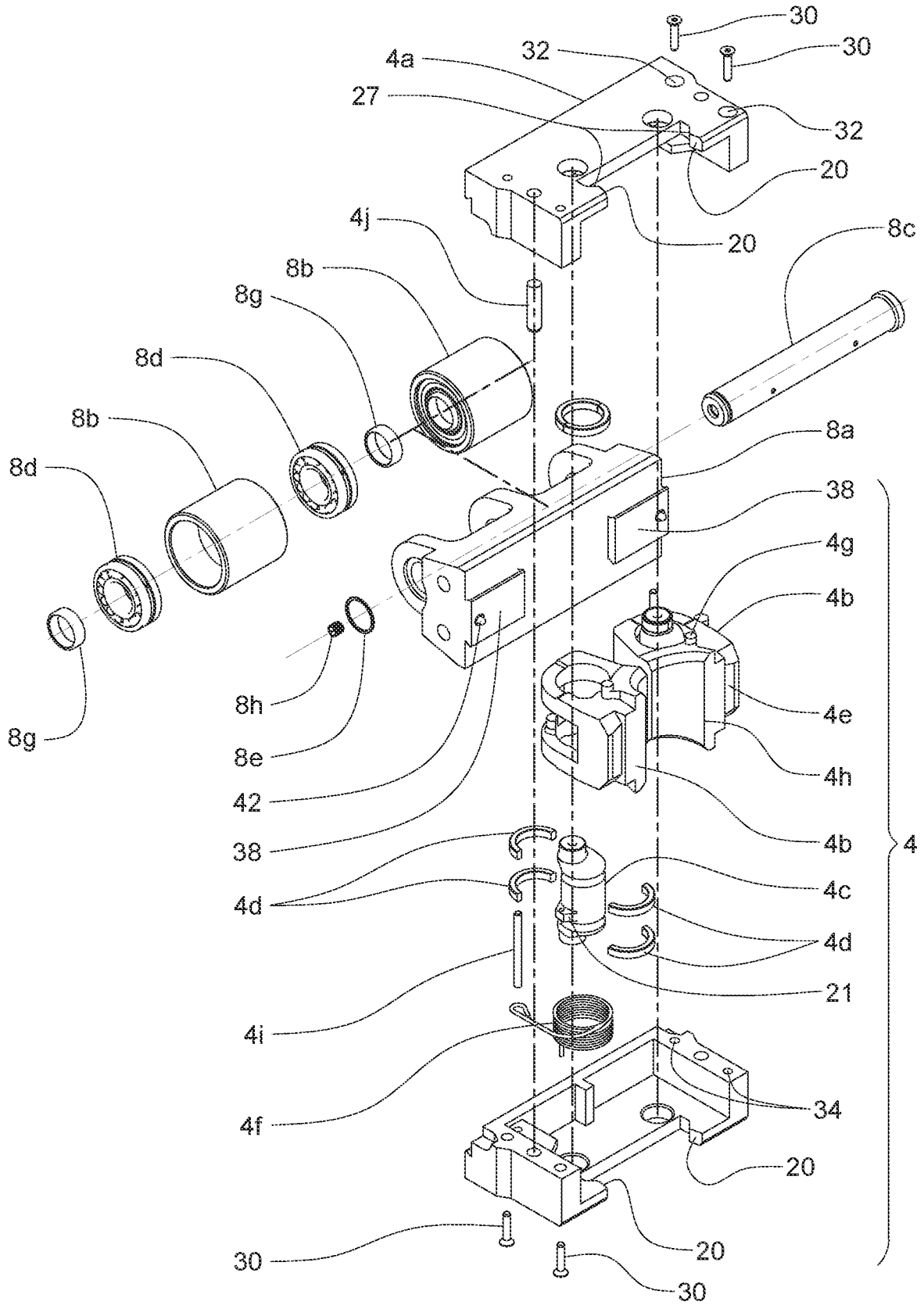
FIG. 19 is an exploded perspective view depicting a gripper block of the injector of FIG. 1.

FIG. 19 shows an exploded view of the embodiment detailed in FIG. 12, showing the following elements: housing half (4*a*), gripping element (4*b*) with beveled edge (4*e*), eccentric shaft (4*c*), bushing halves (4*d*), return spring (4*f*), pivot pin (4*g*), outer corner (4*h*), spring retention pin (4*i*), alignment dowels (4*j*), carrier body (8*a*), roller (8*b*), shaft (8*c*), bearings (8*d*), retaining rings (8*e*) and surface (20) and recess (27).

Figure 20:
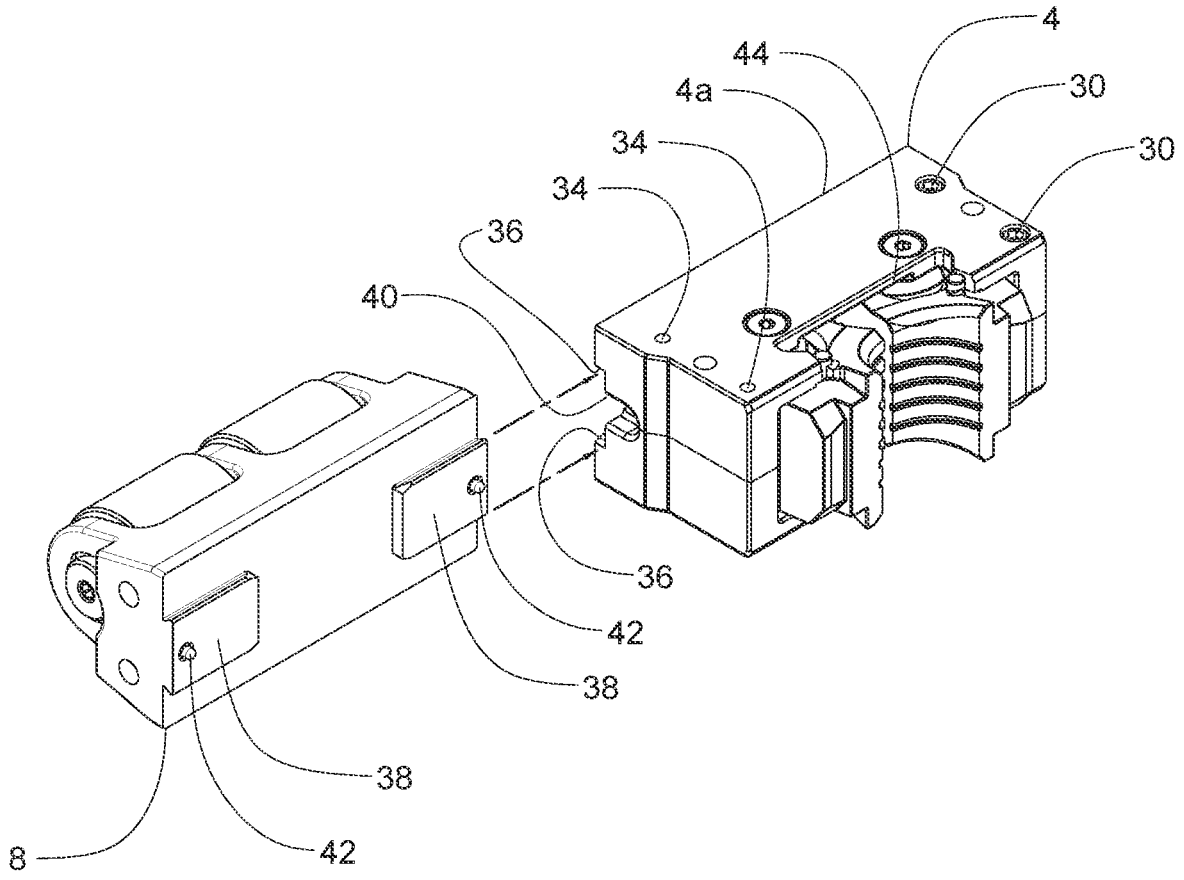
FIG. 20 is a front perspective view depicting the gripper block assembly of FIG. 12 illustrating the carrier assembly being assembled onto the gripper block housing halves.
Figure 21:
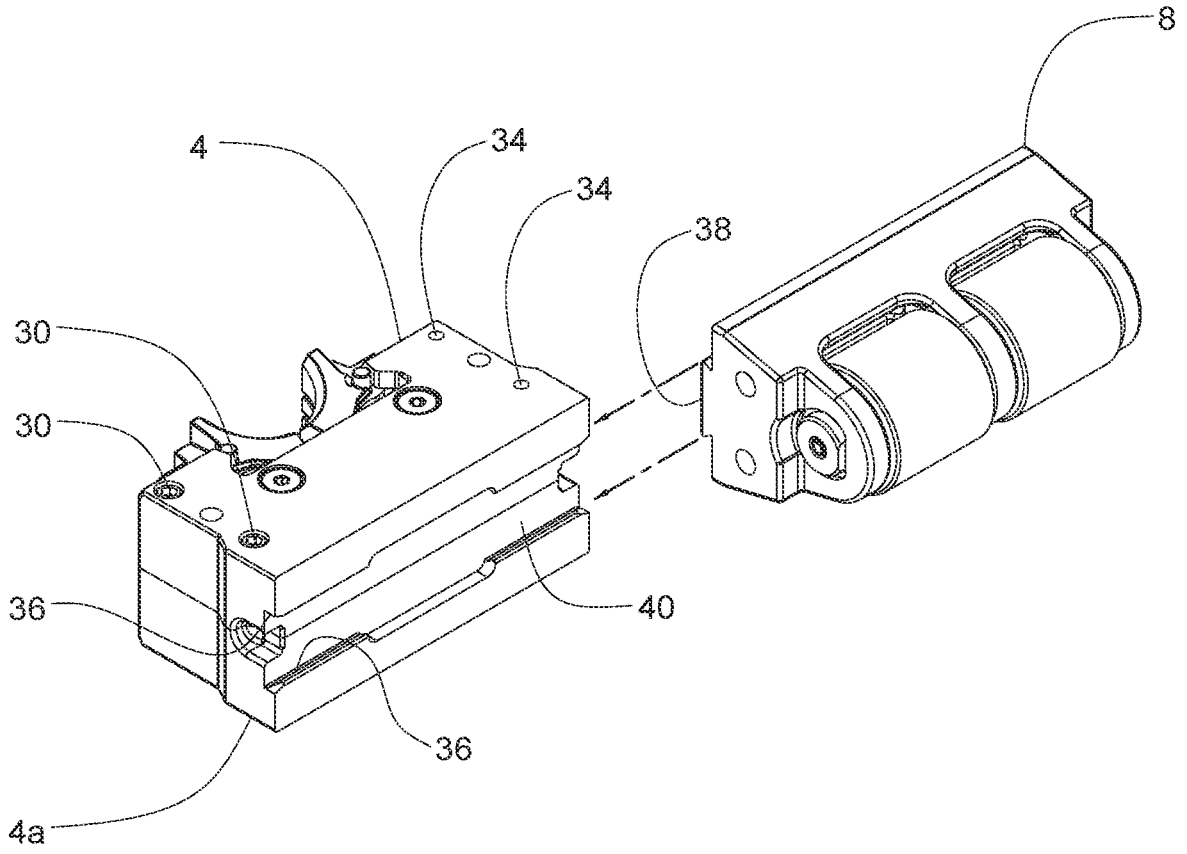
FIG. 21 is a rear perspective view depicting the gripper block assembly of FIG. 12 illustrating the carrier assembly being assembled onto the gripper block housing halves.
Figure 22:
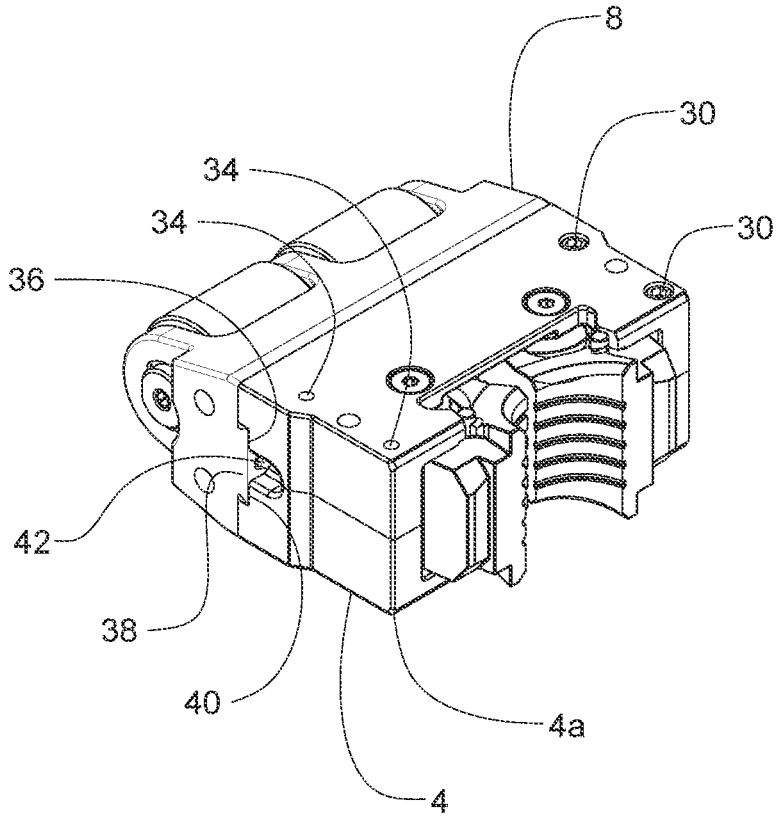
FIG. 22 is a front perspective view depicting the gripper block assembly of FIG. 12 after being assembled.

FIGS. 20 to 22 illustrate how gripper block assembly (4) can be assembled in some embodiments. In some embodiments, each housing half (4*a*) can comprise dovetail groove (36) that can form dovetail slot (40) when two housing halves (4*a*) are assembled. Dovetail slot (40) can receive mating male dovetail profile (38) disposed on carrier assembly (8). When carrier dovetail profile (38) of assembly (8) is slid into dovetail slot (40) of gripper block assembly (4), a spring-loaded pin (42) protruding from each end of the carrier assembly (8) will retain the gripper block assembly (4) to limit the ability of the gripper block assembly (4) to slide off the carrier assembly (8). To remove gripper block assembly (4) from carrier assembly (8), either to replace a worn gripper block assembly (4) or to install different gripper block assemblies (4) configured to work with different sized tubing, spring loaded pin (42) can be depressed and gripper block assembly (4) can slide sideways until the dovetails are disengaged thereby freeing gripper block assembly (4) for removal.

Figure 23:
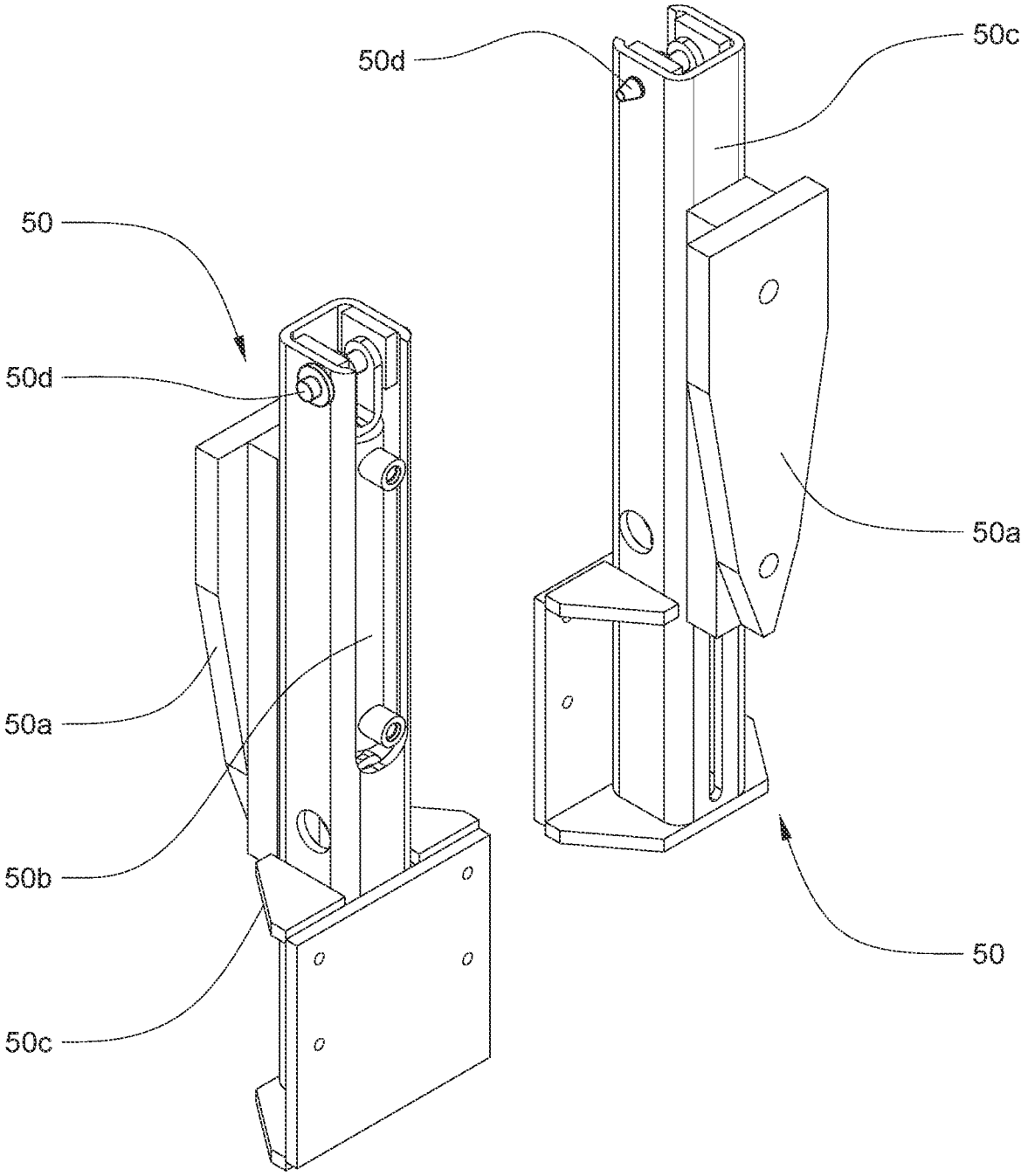
FIG. 23 is an isometric view depicting a pair of the trigger assembly of the injector of FIG. 1.

FIG. 23 shows a detailed view of one embodiment of trigger assembly (50). In some embodiments, trigger assembly (50) can comprise frame (50*c*) and wedge (50*a*) slidably attached to frame (50*c*). A linear actuator (50*b*) can be attached to the outboard end of frame (50*c*) and to wedge (50*a*) with pins (50*d*) disposed therethrough.

FIGS. 24A-D, 25A-D, 26A-D, 27A-D and 28A-D are a series of drawings that illustrate how the trigger assembly of FIG. 1 can be energized when a section of tubular that is tapered or has a larger diameter than the main body of the tubular is encountered and how it interacts with the gripper blocks of FIG. 12. Each set of figures has four views that correspond to a particular point of operation. In these figures, the first view "A" is an isometric view. View "B" is an illustration that shows an isolated view of the tubular with a trigger assembly on each side. View A includes arrows to indicate the direction that the tubing is moving with respect to the trigger assemblies. View "C" is an isolated view of the tubular, the trigger assembly, and the gripper blocks viewed perpendicular to view A with a sectioning view mark that indicates the location relative to the top plan view of the gripper block, which is shown in view "D".

Figure 24A:
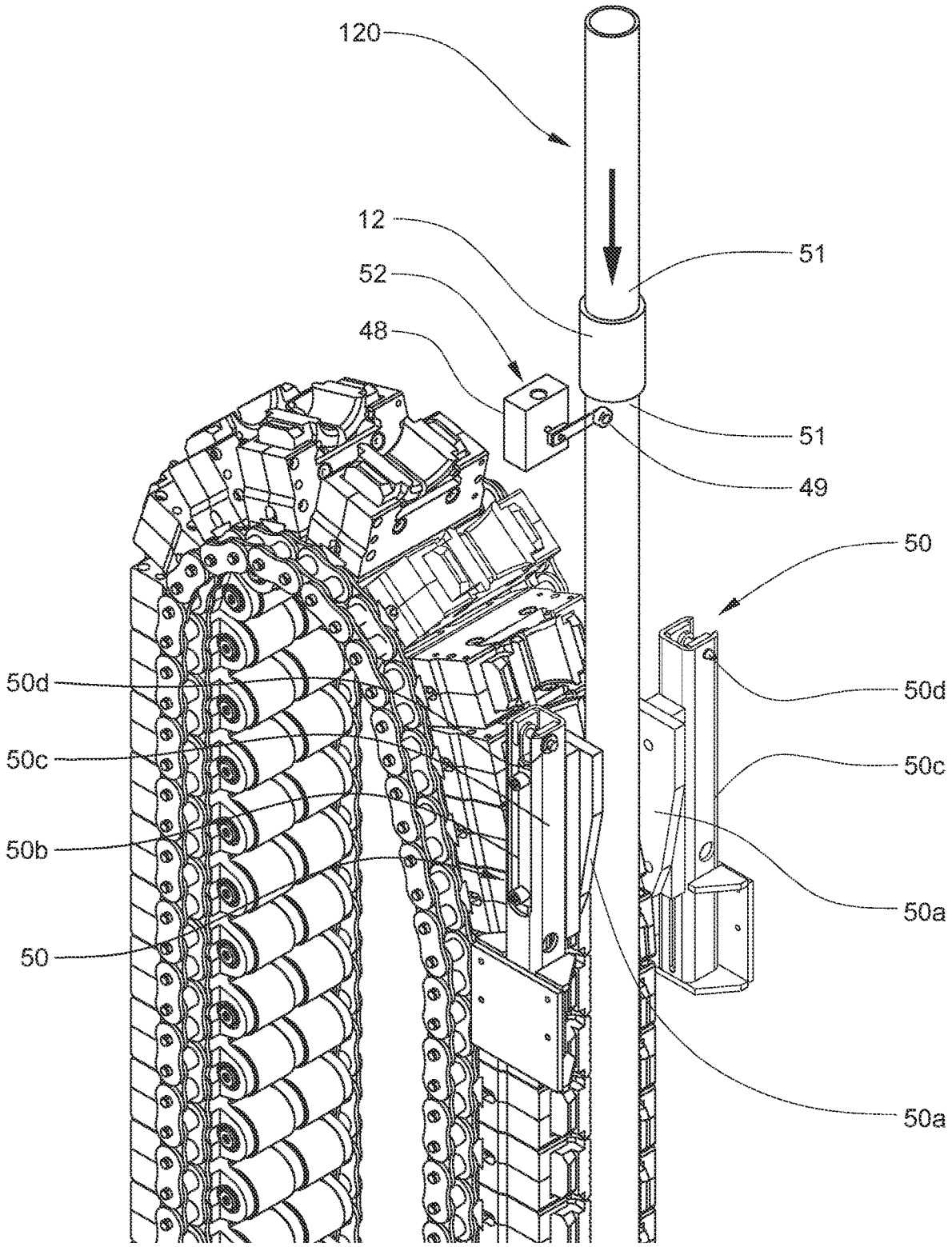
FIG. 24A is an isometric view depicting the trigger assembly prior to the sensing toggle coming into contact with the larger diameter section of the tubing as the tubing is being injected.

FIG. 24A is an isometric view depicting the position of trigger assembly (50) and coupling sensor (52) prior to sensing toggle (49) coming into contact with the larger diameter section of tubing (51) or coupling (12) as tubing string (120) is being injected.

Figure 24B:
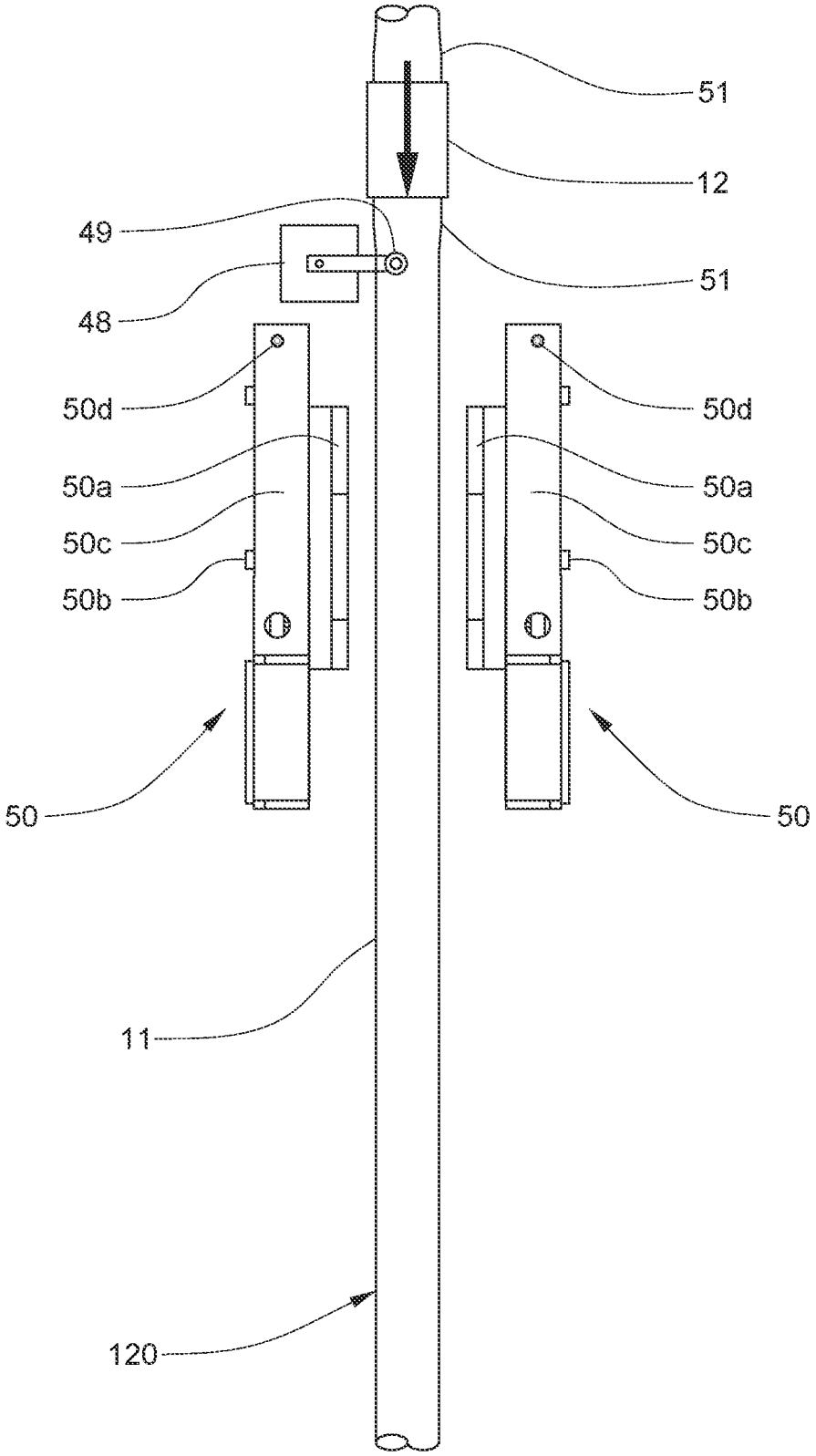
FIG. 24B is a side elevation view depicting the trigger assembly prior to the sensing toggle coming into contact with the larger diameter section of the tubing as the tubing is being injected into a well.
Figure 24C:
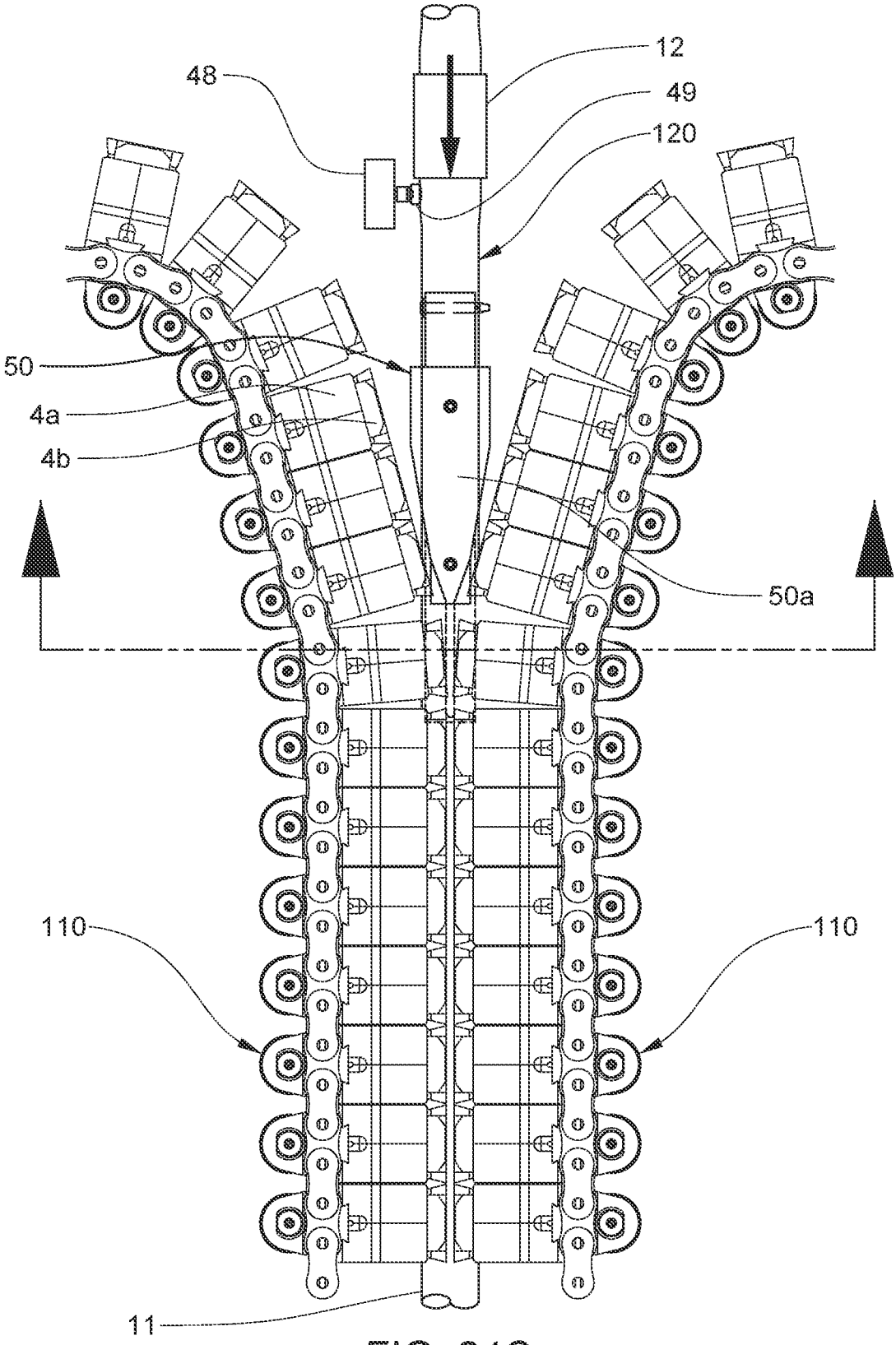
FIG. 24C is a front elevation view depicting the trigger assembly of FIG. 24B.
Figure 24D:
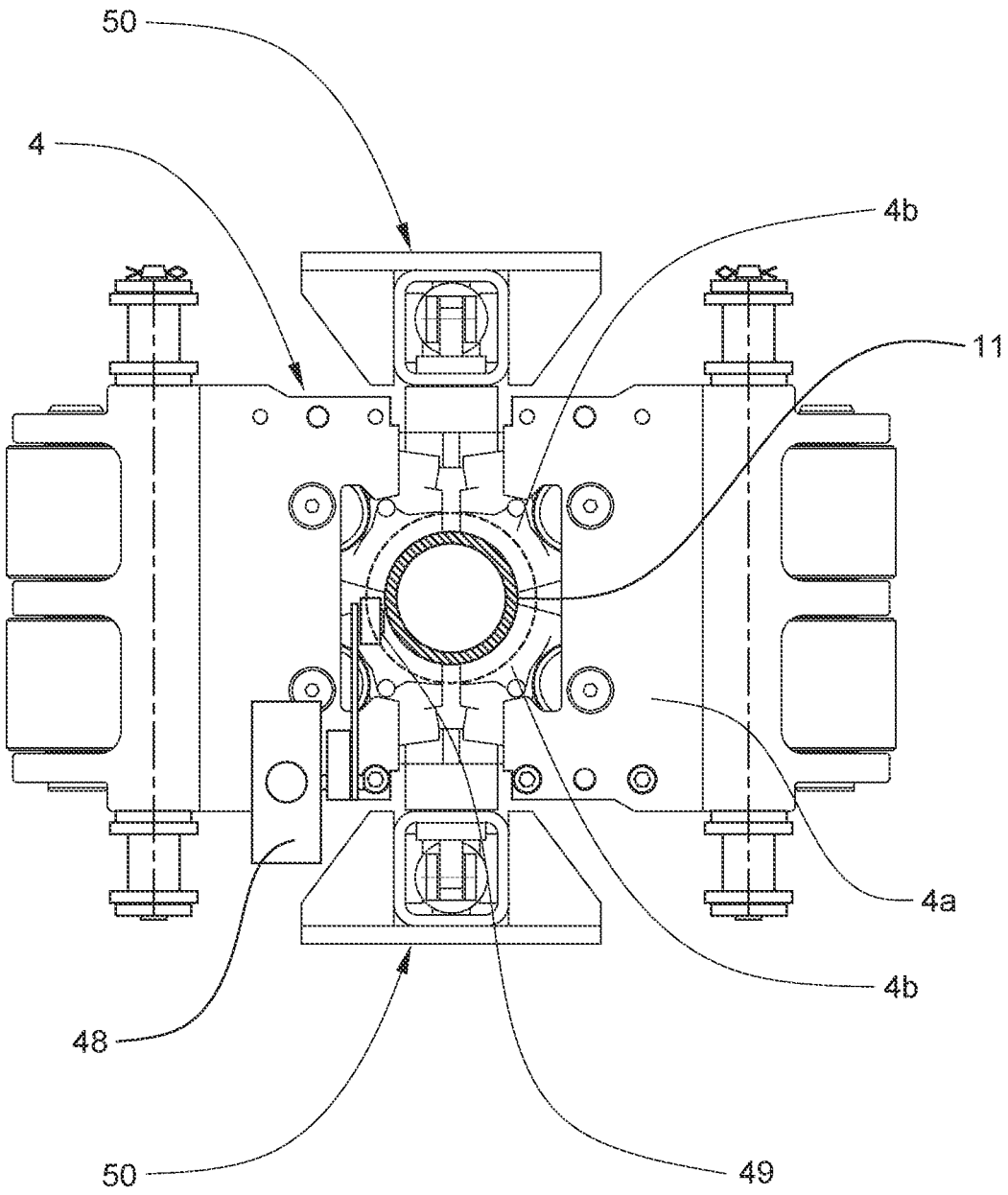
FIG. 24D is a top plan view depicting the trigger assembly of FIG. 24C along the section line of FIG. 24C.

In FIG. 24B, tapered upset section (51) of tubing (11) is shown coming into contact with sensing toggle (49) as tubing string (120) passes through the injector of FIG. 1. It can be seen in FIG. 24C that trigger assembly (50) can be positioned in the injector of FIG. 1 at a point centred between counter-rotating gripper chains (110) where gripper block jaws (4*b*) can pass by wedge (50*a*) unaffected. FIG. 24C includes a section view line that indicates the corresponding point where FIG. 24D is depicted. FIG. 24D is a top plan view that shows the position of gripper jaws (4*b*) fully extended from gripper block housing (4*a*) and locked on the nominal diameter of tubular (11). As shown in this embodiment, no part of trigger assembly (50) is in contact with gripper block jaws (4*b*).

Figure 25A:
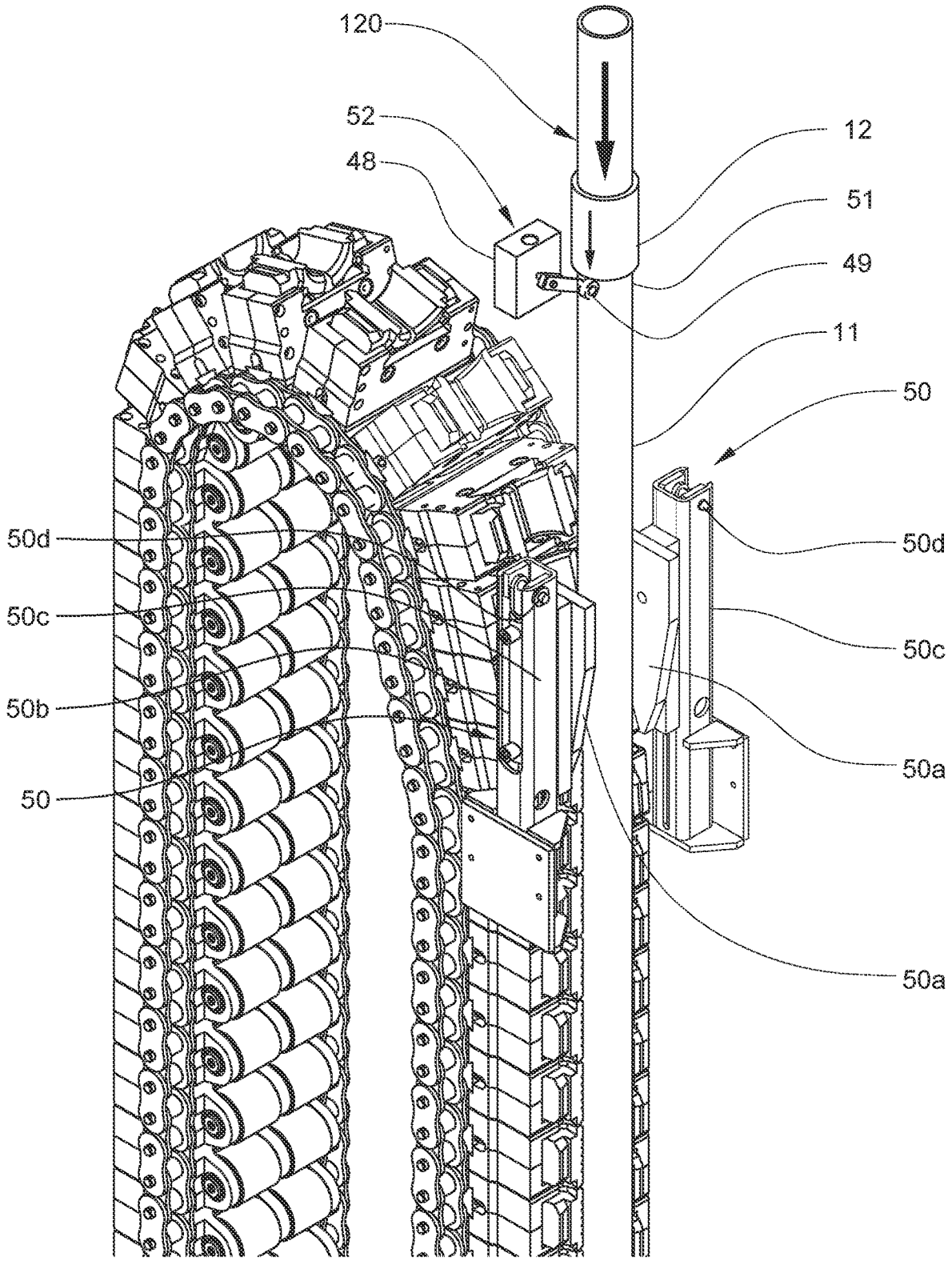
FIG. 25A is an isometric view depicting the trigger assembly as the sensing toggle is in contact with the larger diameter section of the tubing as the tubing is being injected and moves in the direction of travel of the tubular string.

FIG. 25A is an isometric view depicting the position of trigger assembly (50) as sensing toggle (49) is in contact with the larger diameter section of tubing (51) as tubing string (120) is being injected. As shown, sensing toggle (49) can move in the direction of travel of tubular string (120).

Figure 25B:
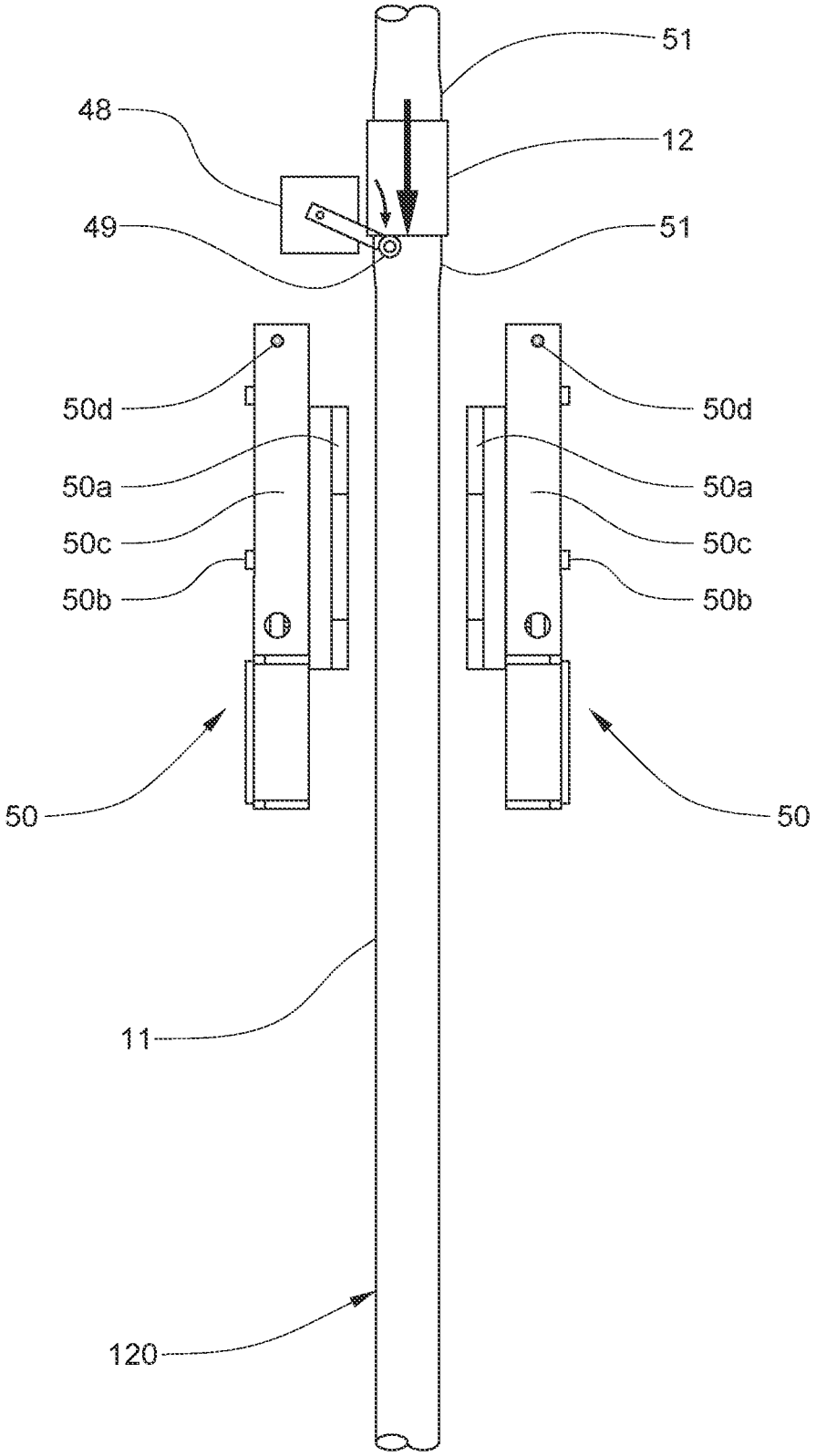
FIG. 25B is a side elevation view depicting the trigger assembly as it moves in the direction of travel of the tubular string.
Figure 25C:
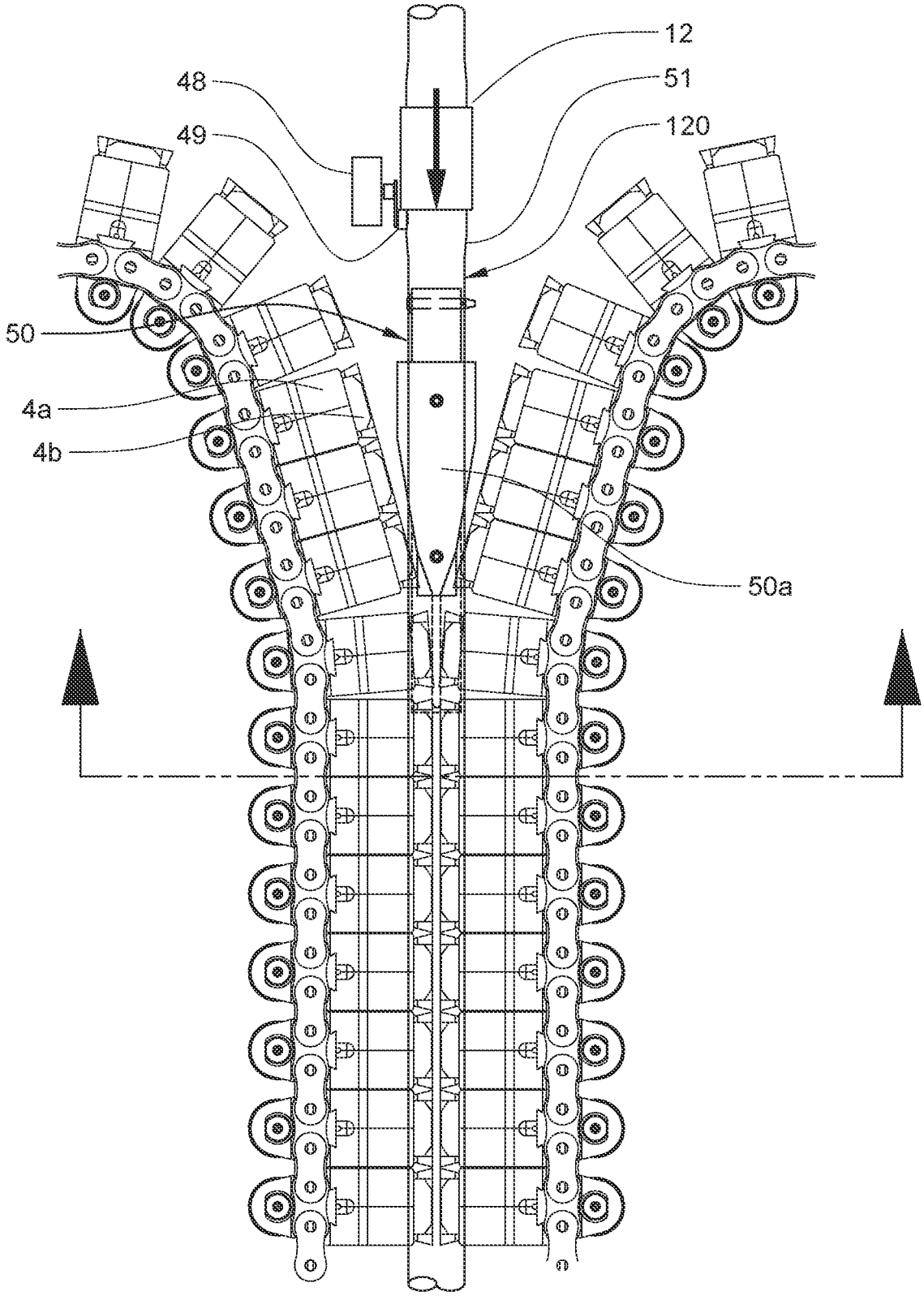
FIG. 25C is a front elevation view depicting the trigger assembly of FIG. 25B.
Figure 25D:
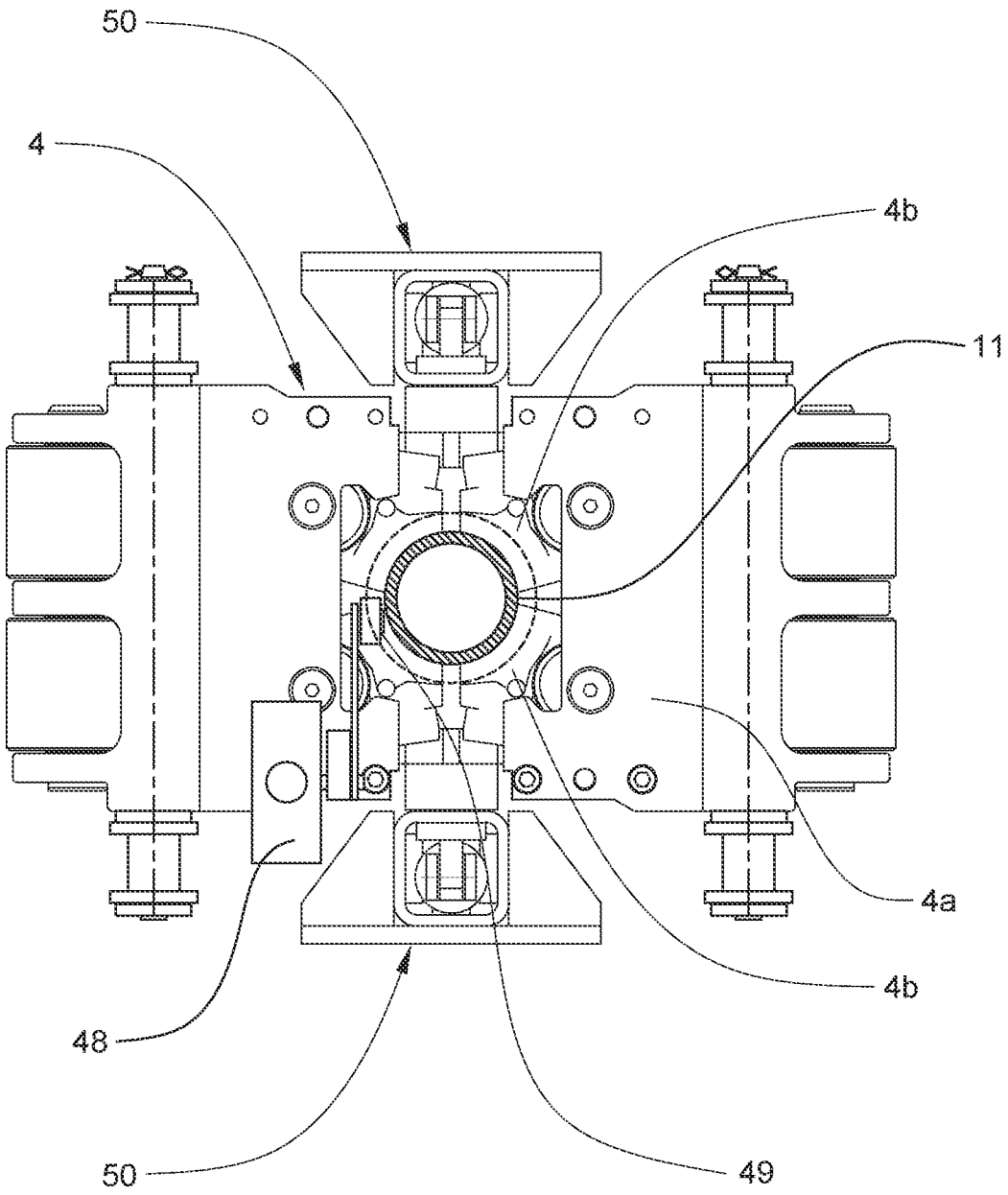
FIG. 25D is a top plan view depicting the trigger assembly of FIG. 25C along the section line of FIG. 25C.

In FIG. 25B, coupling (12) location can be sensed by the interference of sensing toggle (49) and the larger diameter of tapered upset section (51) in relation to the positions of trigger assembly (50) as shown in FIG. 24B. The interference of tapered section (51) with sensing toggle (49) can cause sensing toggle (49) to move rotatably, causing switch (48) to operate and send a signal that corresponds with the location of coupling (12). FIG. 25C shows that sensing toggle (49) has rotatably moved indicating that it has sensed the location of tapered upset section (51) the coupling (12). Wedge (50*a*) is not yet in contact with gripper jaws (4*b*). FIG. 25C includes a section view line that indicates the corresponding point where FIG. 25D is depicted. FIG. 25D is a top plan view that shows that gripper jaws (4*b*) are in contact with the outer diameter of tubular (11).

Figure 26A:
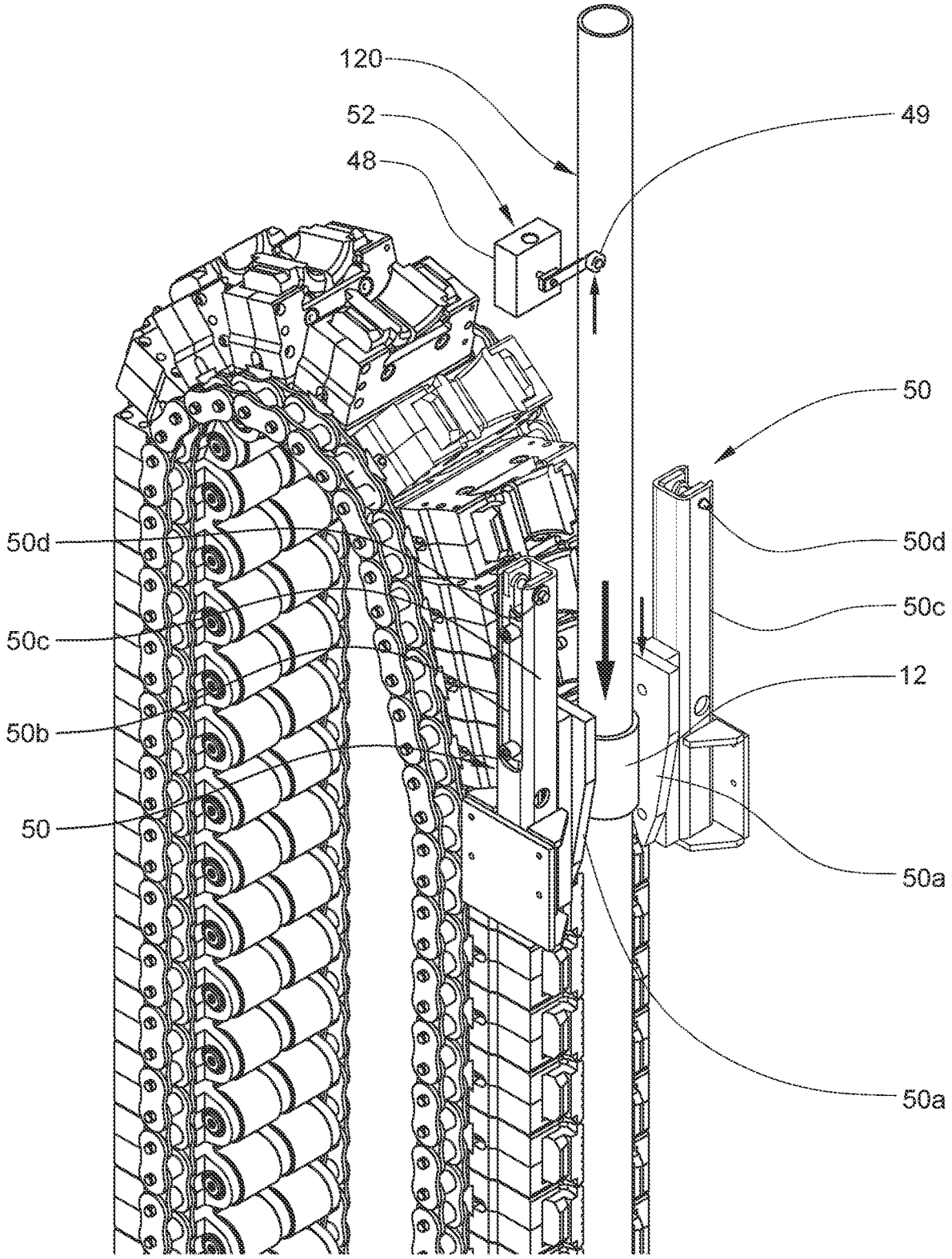
FIG. 26A is an isometric view depicting the trigger assembly as it moves in the direction of travel of the tubular string.
Figure 26B:
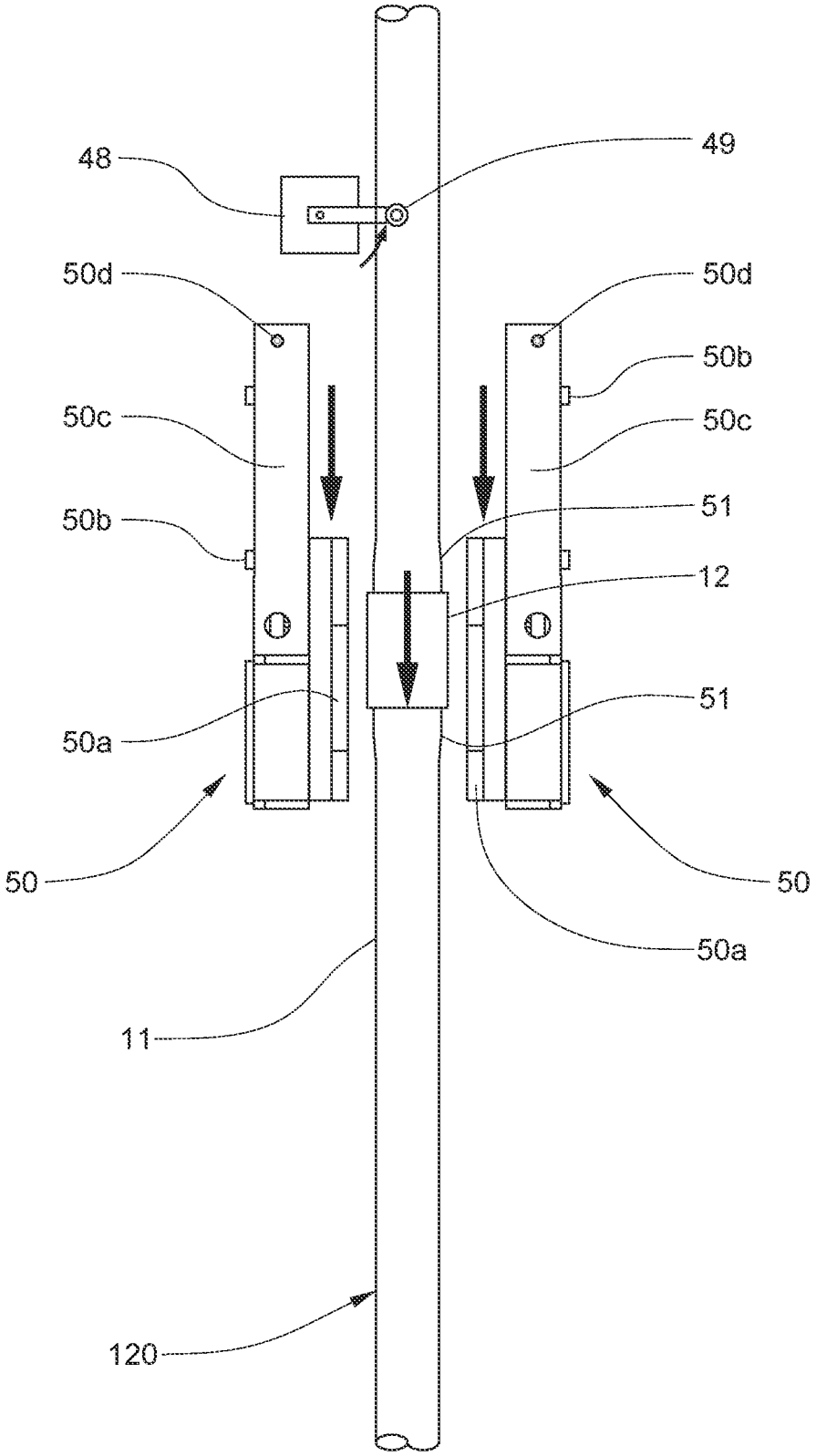
FIG. 26B is a side elevation view depicting the trigger assembly as it moves in the direction of travel of the tubular string.
Figure 26C:
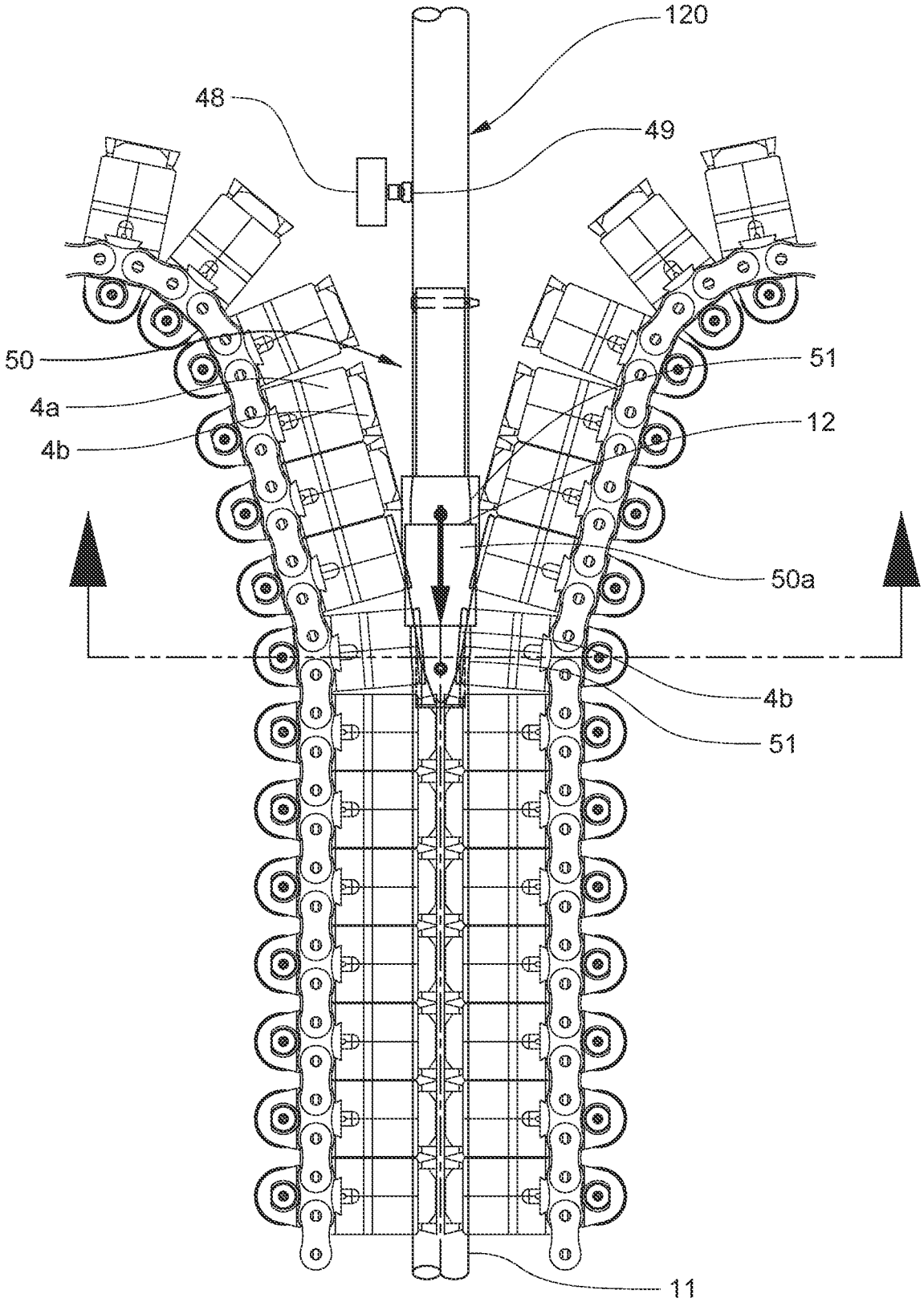
FIG. 26C is a front elevation view depicting the trigger assembly of FIG. 26B.
Figure 26D:
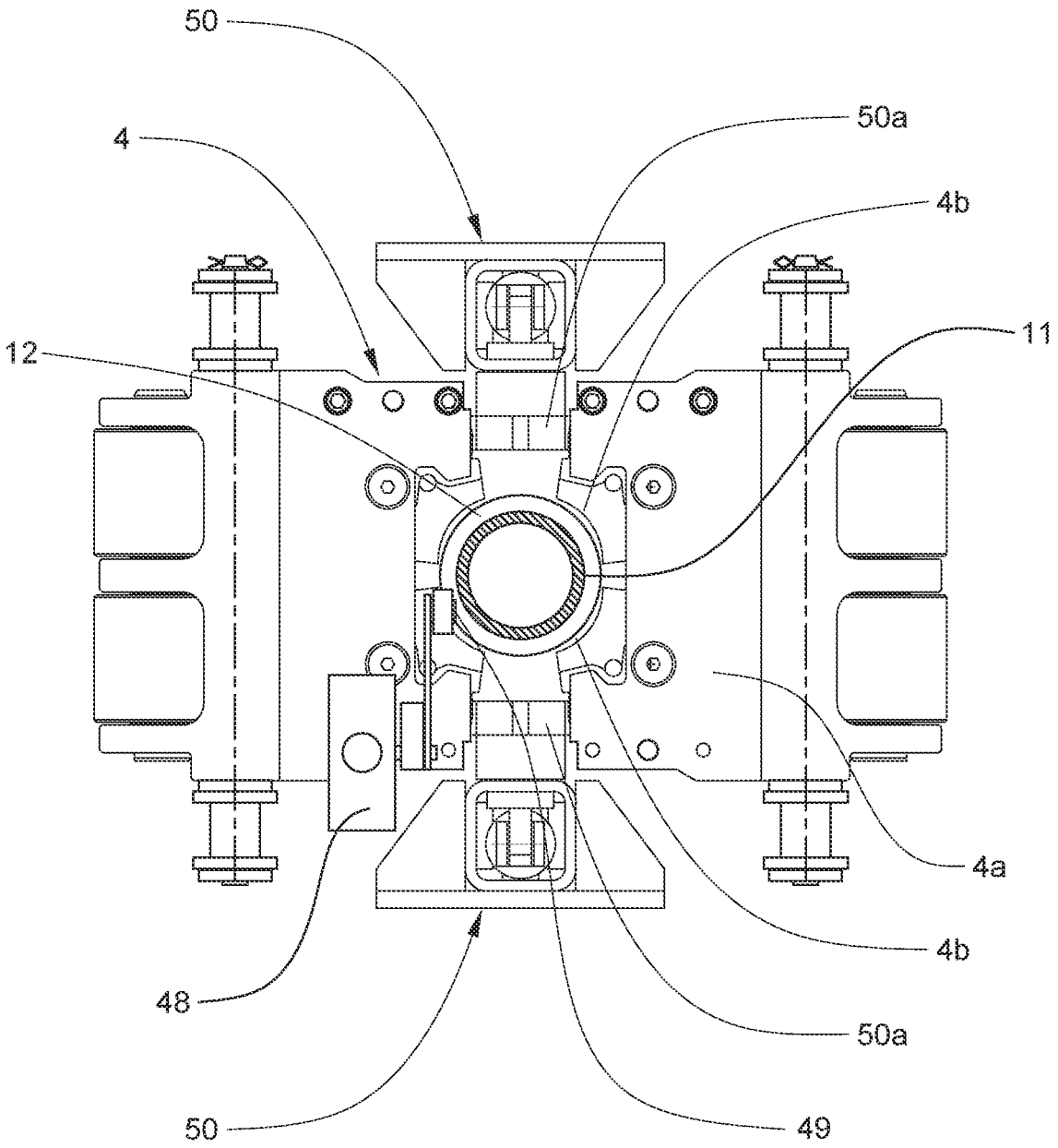
FIG. 26D is a top plan view depicting the trigger assembly of FIG. 26C along the section line of FIG. 26C.

FIG. 26A is an isometric view depicting trigger assembly (50) and coupling sensor (52) as trigger assembly (50) moves in the direction of travel of tubular string (120). FIG. 26B illustrates that linear actuators (50*b*) have extended causing wedges (50*a*) to be adjacent to the larger diameter of tapered upset section (51) and tubing coupler (12) causing gripper jaws (4*b*) to fully retract into housings (4*a*), as can be seen in FIG. 26C and FIG. 26D. At this stage, sensing toggle (49) has returned to it's neutral position. In some embodiments, gripper block jaw (4*b*) can comprise beveled section (4*e*), as shown in FIG. 19, to ensure that gripper jaw (4*b*) does not bind or jam on wedge (50*a*). FIG. 26C illustrates that gripper jaws (4*b*) are in contact with wedge (50*a*) causing gripper jaws (4*b*) to retract into gripper block housings (4*a*) at all points on tubular string (120) adjacent to a tapered upset section (51) of tubular (11) or to a coupling (12), as illustrated in FIG. 18, and that gripper jaws (4*b*) are extended from housings (4*a*) and engaged on the main body of tubular (11), as illustrated in FIG. 13, in areas where gripper jaws (4*b*) are not adjacent to a tapered upset section (51) of tubular (11) or to a coupling (12). It can be seen in FIG. 26D that when wedges (50*a*) are in full contact with gripper jaws (4*b*), coupler (12) is not in contact with gripper jaws (4*b*).

Figure 27A:
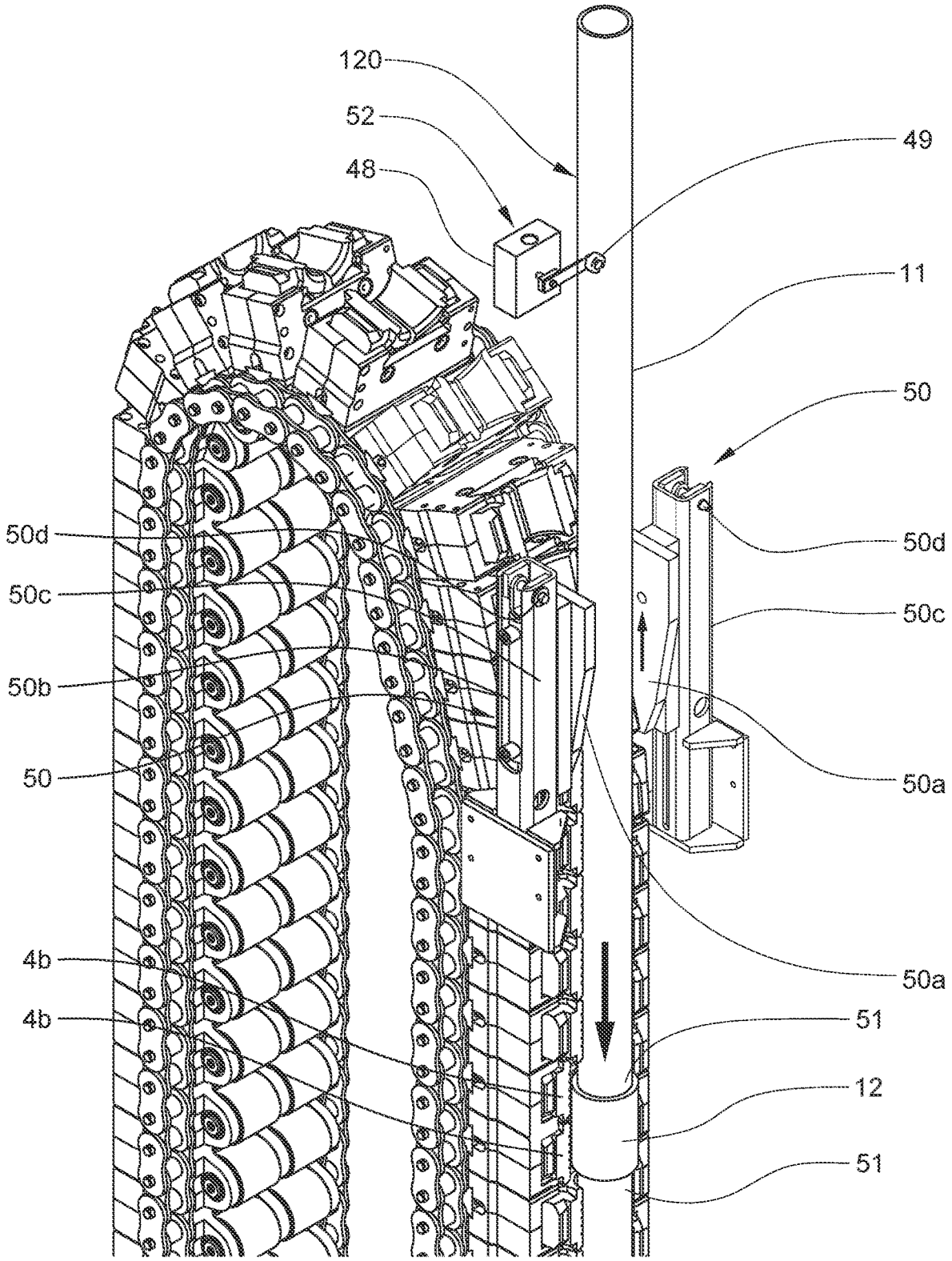
FIG. 27A is an isometric view depicting the trigger assembly after the larger diameter section of the tubing has been fully encapsulated by open gripper blocks.
Figure 27B:
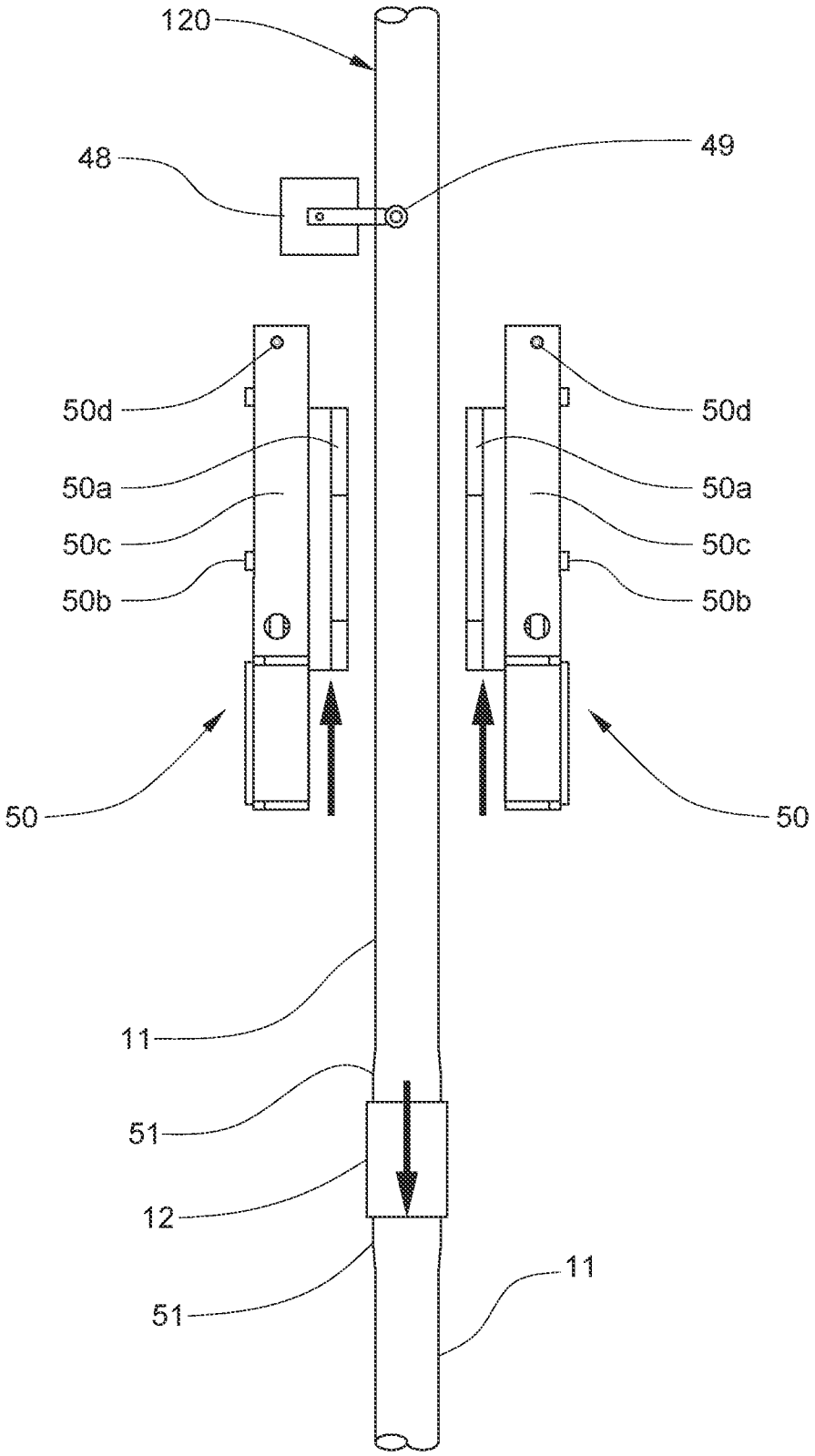
FIG. 27B is a side elevation view depicting the trigger assembly after the larger diameter section of the tubing has been fully encapsulated by open gripper blocks.
Figure 27C:
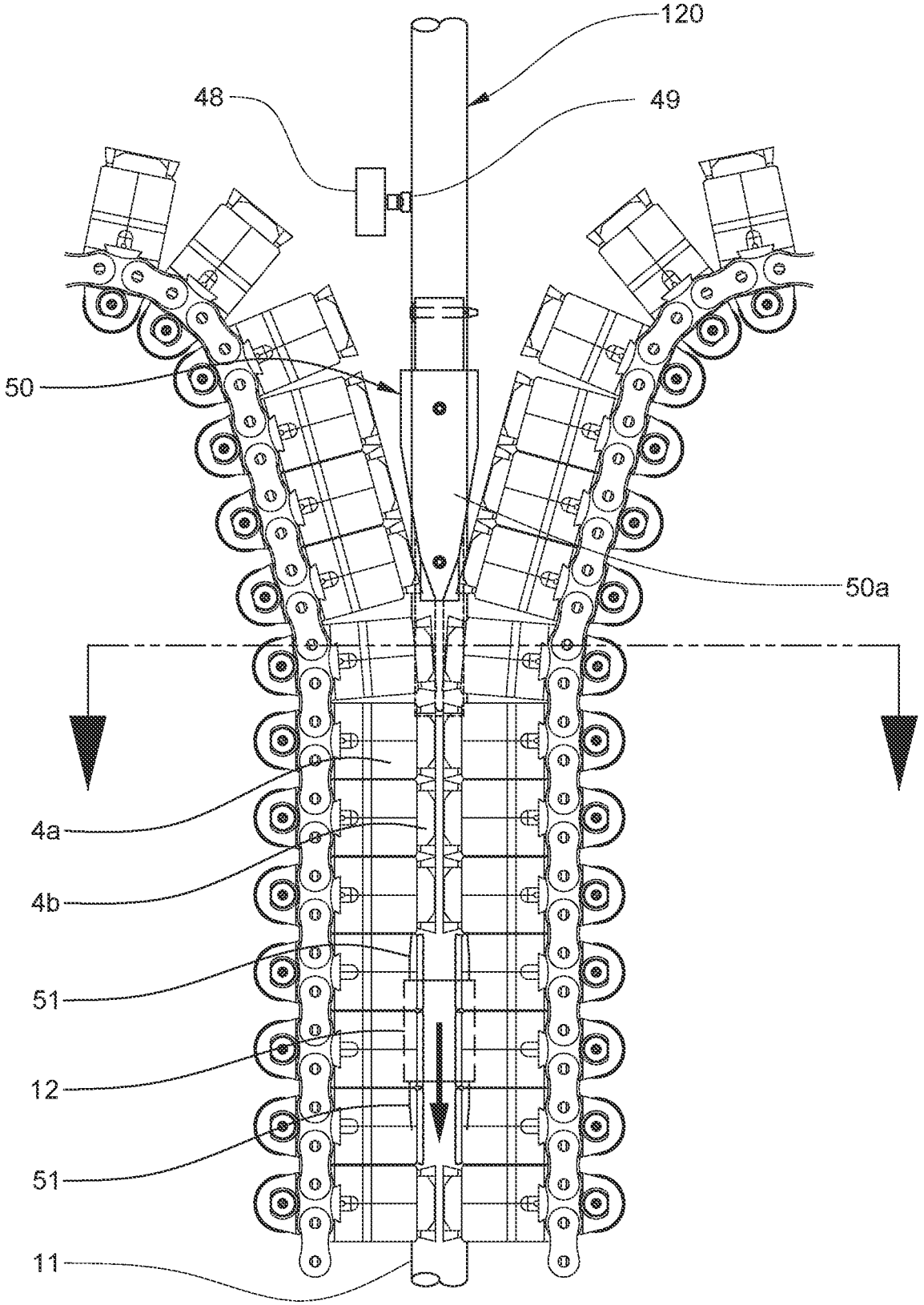
FIG. 27C is a front elevation view depicting the trigger assembly of FIG. 27B.
Figure 27D:
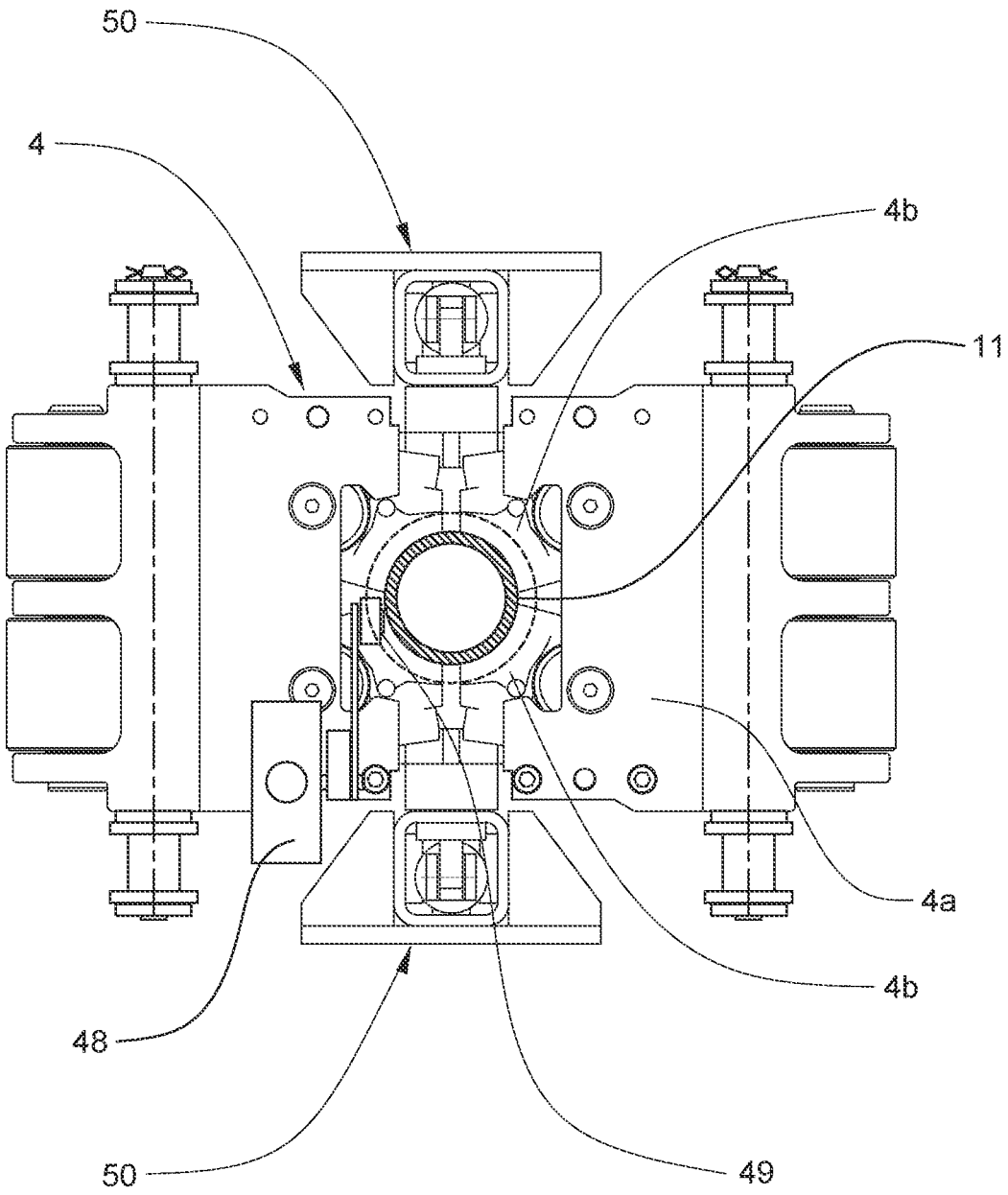
FIG. 27D is a top plan view depicting the trigger assembly of FIG. 27C along the section line of FIG. 27C.

FIG. 27A is an isometric view depicting trigger assembly (50) after the larger diameter sections of tubing (51) and coupling (12) has been fully encapsulated by open gripper jaws (4*b*). FIGS. 27A and 27B show that as tubular string (120) continues through the injector of FIG. 1, linear actuators (50*b*) can retract wedges (50*a*) mounted on frame (50*c*). Gripper block jaws (4*b*) that are not adjacent to a tapered upset section (51) of tubular (11) or to a coupling (12) are fully extended out of gripper block housings (4*a*). FIG. 27D illustrates that gripper jaws (4*b*) are fully extended and in contact with the nominal diameter of tubing (11).

Figure 28A:
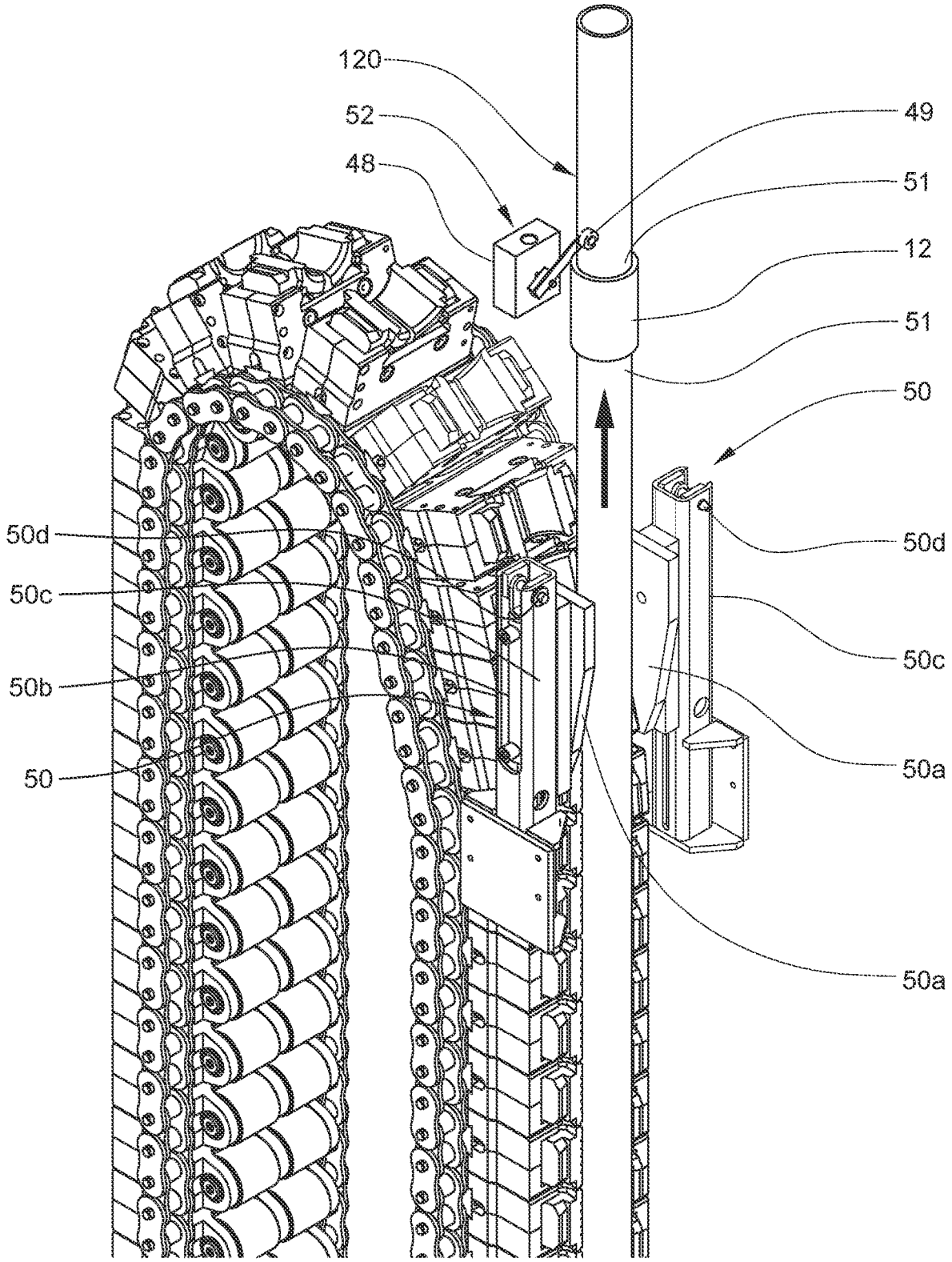
FIG. 28A is an isometric view depicting the sensing toggle interacting with the larger diameter section of the tubing as the tubing is being withdrawn from a well.
Figure 28B:
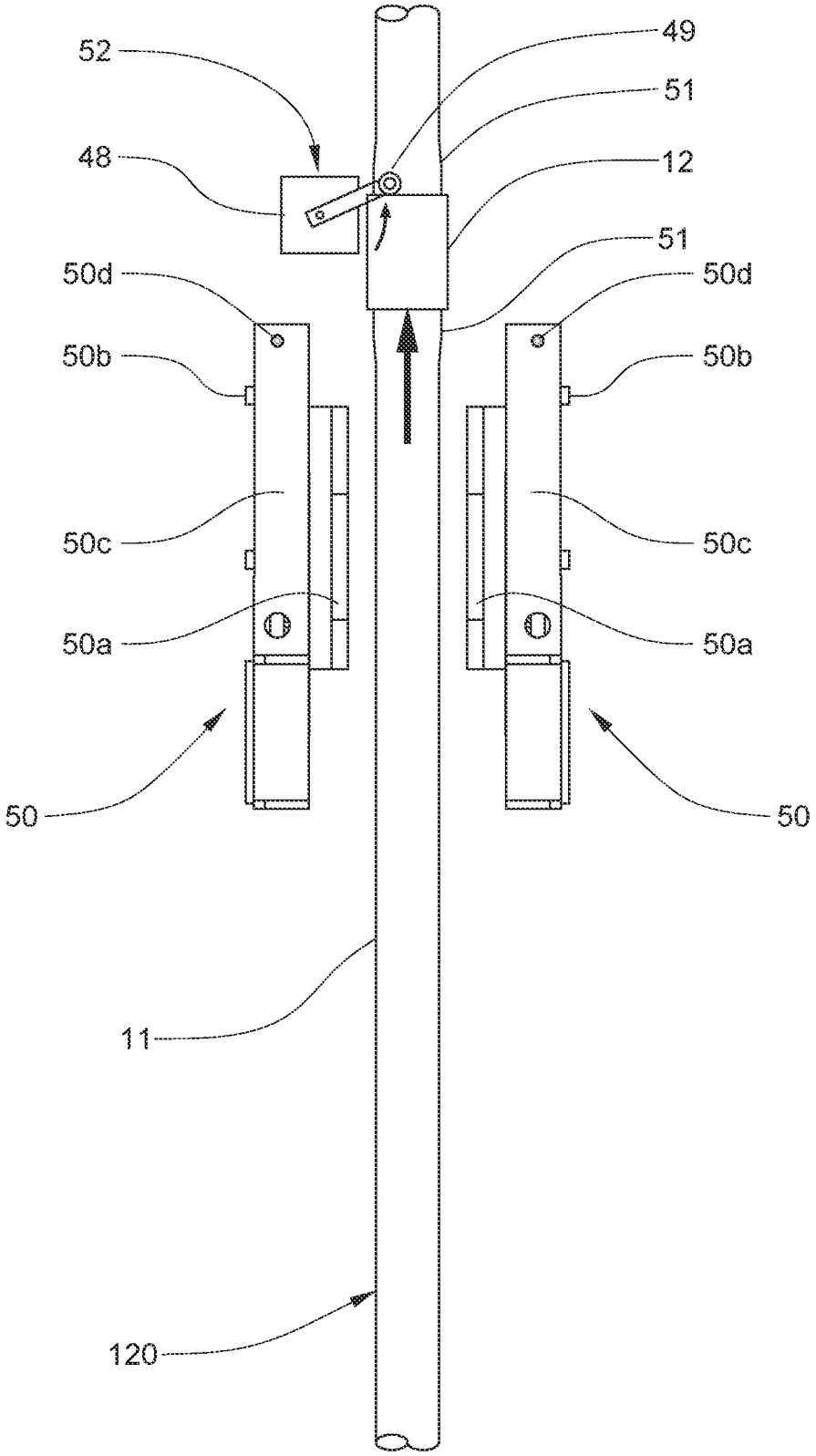
FIG. 28B is a side elevation view depicting the sensing toggle interacting with the larger diameter section of the tubing as the tubing is being withdrawn from a well.
Figure 28C:
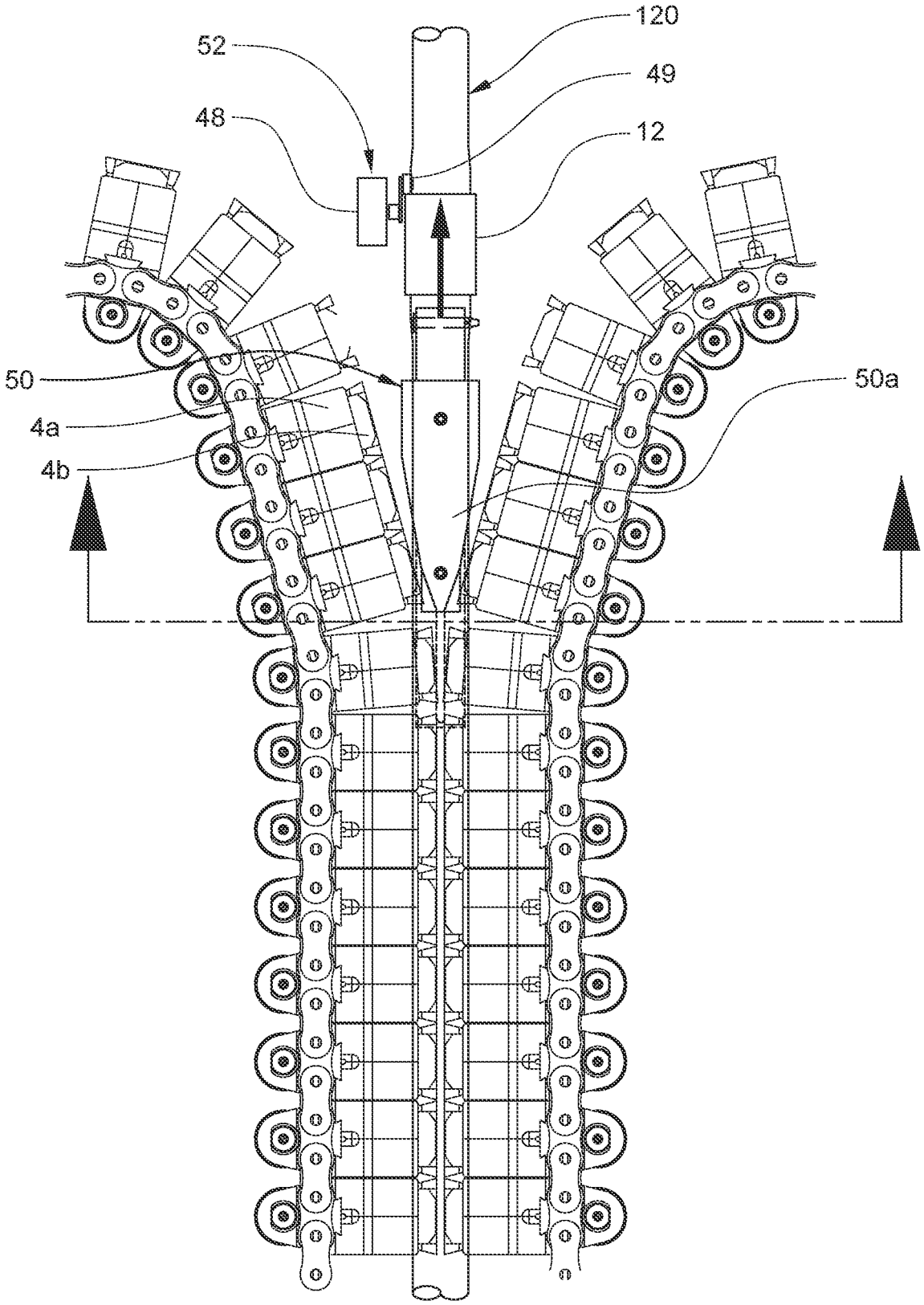
FIG. 28C is a front elevation view depicting the trigger assembly of FIG. 28B.
Figure 28D:
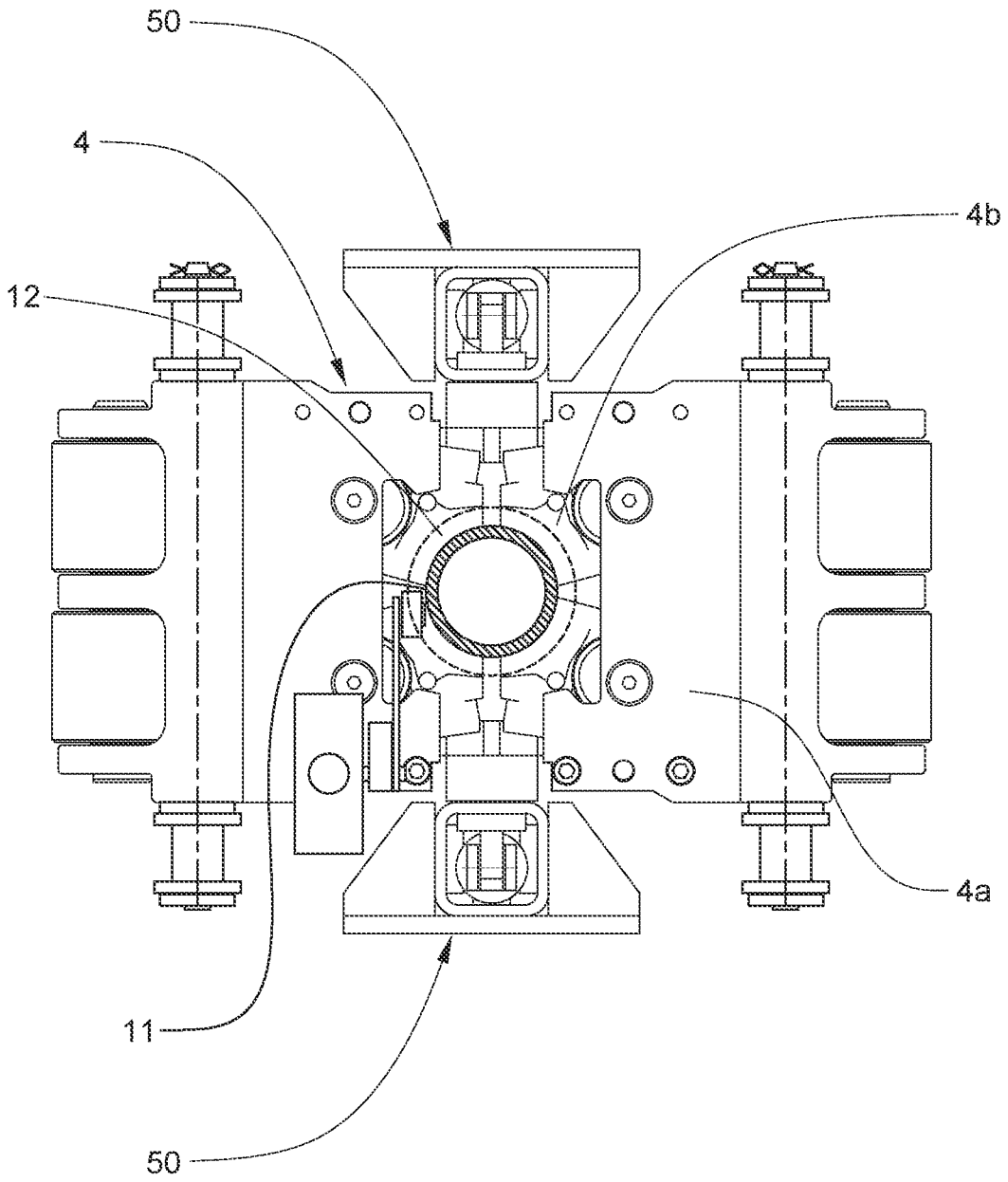
FIG. 28D is a top plan view depicting the trigger assembly of FIG. 28C along the section line of FIG. 28C.

FIG. 28A is an isometric view depicting sensing toggle (49) interacting with the larger diameter section of tubing (51) as tubing string (120) is being withdrawn from a well. FIG. 28B illustrates a tapered upset section (51) of tubular (11) or a coupling (12) making contact with sensing toggle (49) while tubular string (120) is moving the opposite direction from that shown in FIGS. 24 through 27C, namely, upwards as is the case when tubular string (120) is being withdrawn from a well. In some embodiments, coupling Sensor (52) can sense a tapered upset section (51) of tubular (11) or coupling (12) and can then signal that coupling (12) has passed completely through the injector of FIG. 1. As shown in FIG. 28C, wedges (50*a*) are not in contact with gripper jaws (4*b*). In order for gripper jaws (4*b*) to retract when tubular string (120) is moving in either direction, trigger assemblies (50) can be situated at each end and on each side of injector (100), as illustrated in FIG. 2, and can be situated opposing each other in order to be effective when the tubing is moving in either direction. Thus, in the illustrated embodiments shown in the figures, a first set of trigger assemblies (50) can be disposed near the upper end of injector (100) for operating gripper block assemblies (4) when the tubing is being injected into a well, and a second set of trigger assemblies (50) can disposed near the lower end of injector (100) for operating gripper block assemblies (4) when the tubing is being retracted out of a well. FIG. 28C shows that as the larger diameter section of tubing (51) or of coupler (12) passes the point where gripper assemblies (4) are being forced towards each other, gripper jaws (4*b*) that were retracted into gripper housings (4*a*) can then fully extend to their initial position. In FIG. 28D, gripper jaws (4*b*) can be seen extended to illustrate the position they would be in at the point where the section line is shown in FIG. 28C.

Figure 29:
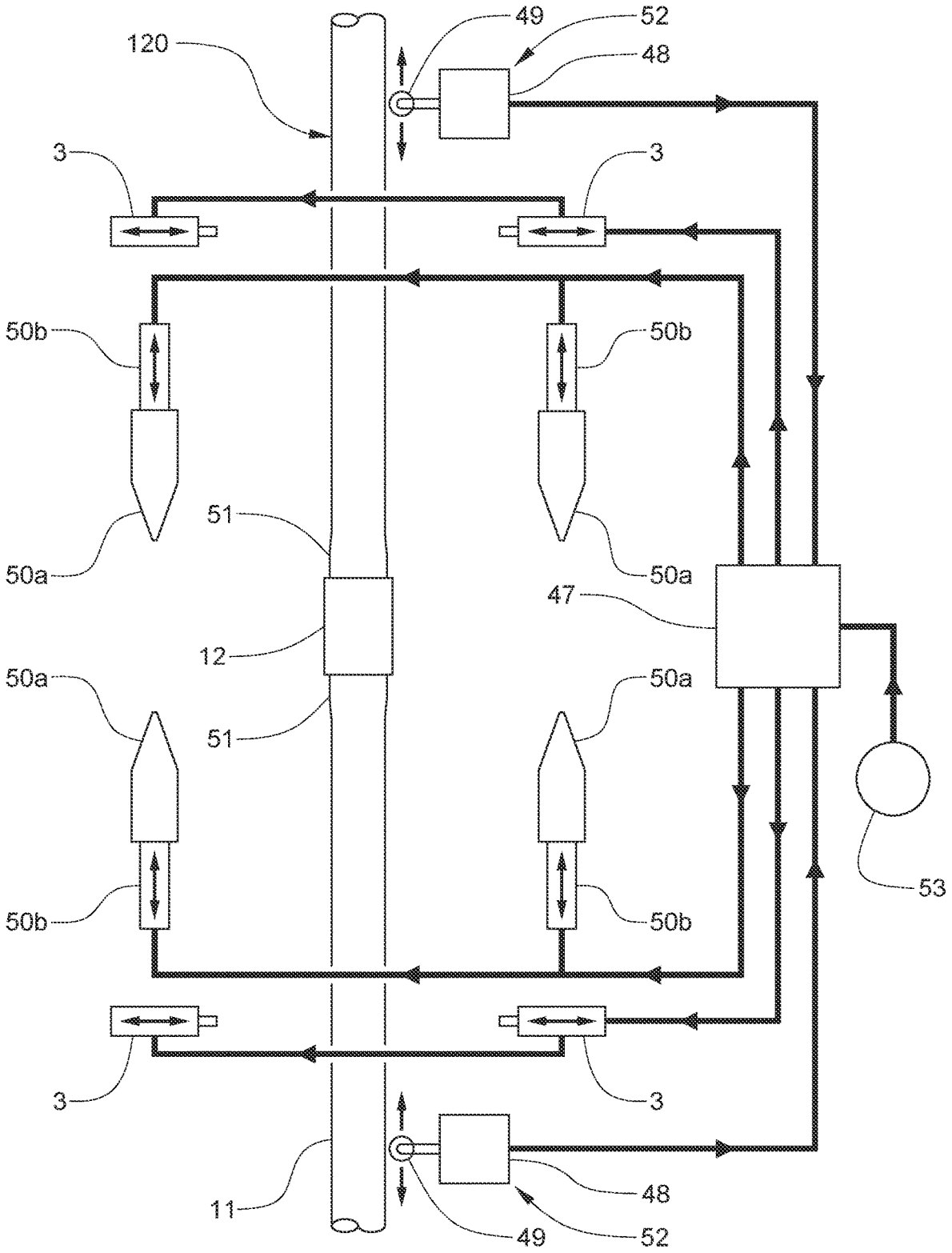
FIG. 29 is a schematic block diagram depicting a control system for controlling the trigger assembly described herein.

FIG. 29 is an illustration of the components that make up one embodiment of the trigger system and control system thereof. In some embodiments, the control system can comprise one or more of a general purpose computer, a microcontroller, a microprocessor and a programmable logic controller, as well known to those skilled in the art. In a representative embodiment, the control system can comprise of programmable logic controller ("PLC") (47). In some embodiments, the control system can comprise coupling sensor (52) that can further comprise sensing toggle (49) and switch (48). In some embodiments, switch (48) can comprise an electric micro-switch although in other embodiments, switch (48) can comprise one or more of hydraulic, pneumatic and electric as well known to those skilled in the art. If switch (48) comprises an electric-type switch, switch (48) can comprise an explosion-proof enclosure and be rated for Class 1/Division 1 (Zone 1) or Class 1/Division 2 (Zone 2) application depending on the application and location of the site where injector (100) is being operated. In some embodiments, the control system can comprise encoder (53) that can be disposed on idler sprocket shaft (14), as shown in FIGS. 2, 6 and 7. When tapered upset section (51) of tubular (11) or a coupling (12) passes coupling sensor (52), a signal can be sent from coupling sensor (52) to PLC (47). In some embodiments, PLC (47) can cause linear actuators (50*b*) and squeeze cylinders (3) to function at the appropriate time in order to cause trigger assemblies (50) to perform as described above to prevent gripper jaws (4*b*) from contacting tapered upset section (51) and coupling (12), as shown in FIGS. 24A through 28D. In some embodiments, linear actuator (50*b*) can comprise one or more of hydraulic, pneumatic and electric linear actuators as well known to those skilled in the art.

Although a few embodiments have been shown and described, it will be appreciated by those skilled in the art that various changes and modifications can be made to these embodiments without changing or departing from their scope, intent or functionality. In particular, the sensing toggle could be replaced with a proximity switch, limit switch, Vision based system, LVDT, encoder or any combination of sensor or mechanical configuration that can measure distance displacement.

The various illustrative logical blocks, modules, circuits, and algorithm steps described in connection with the embodiments disclosed herein can be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans can implement the described functionality in varying ways for each particular application, but such implementation decisions should not be interpreted as causing a departure from the scope of the embodiments described herein.

Embodiments implemented in computer software can be implemented in software, firmware, middleware, microcode, hardware description languages, or any combination thereof. A code segment or machine-executable instructions can represent a procedure, a function, a subprogram, a program, a routine, a subroutine, a module, a software package, a class, or any combination of instructions, data structures, or program statements. A code segment can be coupled to another code segment or a hardware circuit by passing and/or receiving information, data, arguments, parameters, or memory contents. Information, arguments, parameters, data, etc. can be passed, forwarded, or transmitted via any suitable means including memory sharing, message passing, token passing, network transmission, etc.

The actual software code or specialized control hardware used to implement these systems and methods is not limiting of the embodiments described herein. Thus, the operation and behavior of the systems and methods were described without reference to the specific software code being understood that software and control hardware can be designed to implement the systems and methods based on the description herein.

When implemented in software, the functions can be stored as one or more instructions or code on a non-transitory computer-readable or processor-readable storage medium. The steps of a method or algorithm disclosed herein can be embodied in a processor-executable software module, which can reside on a computer-readable or processor-readable storage medium. A non-transitory computer-readable or processor-readable media includes both computer storage media and tangible storage media that facilitate transfer of a computer program from one place to another. A non-transitory processor-readable storage media can be any available media that can be accessed by a computer. By way of example, and not limitation, such non-transitory processor-readable media can comprise RAM, ROM, EEPROM, CD-ROM or other optical disk storage, magnetic disk storage or other magnetic storage devices, or any other tangible storage medium that can be used to store desired program code in the form of instructions or data structures and that can be accessed by a computer or processor. Disk and disc, as used herein, include compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm can reside as one or any combination or set of codes and/or instructions on a non-transitory processor-readable medium and/or computer-readable medium, which can be incorporated into a computer program product.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A trigger mechanism for a tubing injector for forcibly injecting or retracting a tubular string axially into or out of a well, the tubing injector comprising an upper end and a lower end, the tubular string comprising a plurality of oil field tubulars connected together with tubular connecting elements, the tubing injector comprising a plurality of gripping elements attached to at least two drive chains wherein the tubular string is disposed between the at least two drive chains, the at least two drive chains substantially parallel to each other, the plurality of gripping elements configured to make contact and apply radial force to the tubular string, the tubular connecting elements having a larger diameter than the tubulars, the tubulars comprising a tapered upset section adjacent to the tubular connecting elements, the tapered upset section comprising an upset diameter that is greater in diameter than the tubulars but less than the diameter of the tubular connecting elements, the trigger mechanism comprising:

a) at least one trigger assembly disposed between the at least two drive chains wherein each of the at least one trigger assembly is configured to prevent the plurality of gripping elements from contacting the tubular connecting elements, wherein the at least one trigger assembly comprises:

i) a substantially vertical frame;

ii) a wedge disposed on the frame, wherein the wedge is disposed substantially equidistant from each of the at least two drive chains, the wedge configured to prevent the plurality of gripping elements from contacting the tapered upset section of the tubulars or the tubular connecting elements; and iii) a linear actuator configured to move the wedge in a substantially vertical direction relative to the frame wherein the wedge prevents the plurality of gripping elements from contacting the tubular connecting elements; and b) a coupling sensor configured to sense the tapered upset section and the tubular connecting elements when the tubular string is being injected into or retracted out of the well.

2. The trigger mechanism as set forth in claim 1, further comprising a first pair of the at least one trigger assembly wherein the tubular string is disposed between the first pair of the at least one trigger assembly.

3. The trigger mechanism as set forth in claim 2, wherein the first pair of the at least one trigger assembly is configured to operate when the tubular string is being injected into the well.

4. The trigger mechanism as set forth in claim 2, wherein the first pair of the at least one trigger assembly is disposed by the upper end of the tubing injector.

5. The trigger mechanism as set forth in claim 2, further comprising a second pair of the at least one trigger assembly wherein the tubular string is disposed between the second pair of the at least one trigger assembly.

6. The trigger mechanism as set forth in claim 5, wherein the second pair of the at least one trigger assembly is configured to operate when the tubular string is being retracted out of the well.

7. The trigger mechanism as set forth in claim 5, wherein the second pair of the at least one trigger assembly is disposed by the lower end of the tubing injector.

8. The trigger mechanism as set forth in claim 1, further comprising a plurality of the wedge configured to engage pairs of the plurality of gripping elements thereby causing the pairs of the plurality of gripping elements to open and not contact or grip the tapered upset section and the tubular connecting elements as the tubular string is being injected into or retracted out of the well.

9. The trigger mechanism as set forth in claim 1, wherein the linear actuator is configured to extend and retract the wedge relative to the frame.

10. The trigger mechanism as set forth in claim 9, wherein the linear actuator comprises one or more of a hydraulic linear actuator, pneumatic linear actuator and an electric linear actuator.

11. The trigger mechanism as set forth in claim 1, wherein the coupling sensor comprises an electrical switch and a sensing toggle operatively coupled thereto.

12. The trigger mechanism as set forth in claim 11, wherein the sensing toggle is configured to rotate when contacted by the tapered upset section of the tubulars when the tubular string is being injected into or retracted out of the well.

13. The trigger mechanism as set forth in claim 11, wherein the coupling sensor comprises a first coupling sensor configured to detect when the tapered upset section and the tubing connecting elements are about to enter the tubing injector when the tubing string is being injected into the well.

14. The trigger mechanism as set forth in claim 13, wherein the first coupling sensor is disposed by the upper end of the tubing injector.

15. The trigger mechanism as set forth in claim 13, wherein the coupling sensor comprises a second coupling sensor configured to detect when the tapered upset section and the tubing connecting elements are about to enter the tubing injector when the tubing string is being retracted from the well.

16. The trigger mechanism as set forth in claim 15, wherein the first coupling sensor is disposed by the lower end of the tubing injector.

17. The trigger mechanism as set forth in claim 1, further comprising a control system operatively coupled to the at least one trigger assembly and to the coupling sensor.

18. The trigger mechanism as set forth in claim 17, wherein the control system comprises one or more of a general purpose computer, a microcontroller, a microprocessor and a programmable logic controller.

19. A method for using the trigger mechanism set forth in claim 1 for injecting a tubing string into a well.

20. A method for using the trigger mechanism set forth in claim 1 for retracting a tubing string from a well.

* * * * *